US009711841B2

(12) United States Patent
Yong

(10) Patent No.: US 9,711,841 B2
(45) Date of Patent: Jul. 18, 2017

(54) APPARATUS FOR TUNING MULTI-BAND FRAME ANTENNA

(71) Applicant: Sony Corporation, Tokyo (JP)

(72) Inventor: Check Chin Yong, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 297 days.

(21) Appl. No.: 14/476,048

(22) Filed: Sep. 3, 2014

(65) Prior Publication Data

US 2015/0084817 A1 Mar. 26, 2015

Related U.S. Application Data

(60) Provisional application No. 61/880,635, filed on Sep. 20, 2013.

(51) Int. Cl.

| | |
|---|---|
| ***H01Q 1/24*** | (2006.01) |
| ***H01Q 1/50*** | (2006.01) |
| ***H01Q 5/378*** | (2015.01) |
| ***H01Q 5/335*** | (2015.01) |
| *H01Q 3/24* | (2006.01) |

(Continued)

(52) U.S. Cl.

CPC ..... *H01Q 1/243* (2013.01); *H01Q 1/50* (2013.01); *H01Q 5/335* (2015.01); *H01Q 5/378* (2015.01); *H01Q 3/247* (2013.01); *H01Q 5/328* (2015.01); *H01Q 5/35* (2015.01); *H01Q 9/0464* (2013.01); *H01Q 9/145* (2013.01)

(58) Field of Classification Search

CPC ..... H01Q 1/243; H01Q 1/50; H01Q 5/0041; H01Q 5/0062

USPC ..... 343/702

See application file for complete search history.

(56) References Cited

U.S. PATENT DOCUMENTS

| | | | |
|---|---|---|---|
| 7,612,725 | B2 | 11/2009 | Hill et al. |
| 8,270,914 | B2 | 9/2012 | Pascolini et al. |

(Continued)

FOREIGN PATENT DOCUMENTS

| | | | |
|---|---|---|---|
| EP | 2 081 257 | A1 | 7/2009 |
| EP | 2 275 884 | A2 | 1/2011 |
| WO | WO 2014/151558 | A1 | 9/2014 |

OTHER PUBLICATIONS

Extended European Search Report issued Mar. 11, 2015 in Patent Application No. 14185306.9.

(Continued)

*Primary Examiner* — Dameon E Levi
*Assistant Examiner* — Andrea Lindgren Baltzell
(74) *Attorney, Agent, or Firm* — Oblon, McClelland, Maier & Neustadt, L.L.P.

(57) ABSTRACT

A multi-band frame antenna is used for LTE, MIMO, and other frequency bands. The frame antenna includes a conductive block and a metallic frame with no gaps or discontinuities. The conductive block functions as a system ground and has at least one electronic component mounted on the surface. The outer perimeter of the metallic frame surrounds the conductive block, and there is a gap between the metallic frame and the conductive block. One or more antenna feeds are routed across the gap, between the metallic frame and the conductive block. One or more connections can be made across the gap, and at least one electronic element connects the conductive block to the metallic frame.

20 Claims, 22 Drawing Sheets

(51) Int. Cl.

| | |
|---|---|
| *H01Q 9/04* | (2006.01) |
| *H01Q 9/14* | (2006.01) |
| *H01Q 5/328* | (2015.01) |
| *H01Q 5/35* | (2015.01) |

(56) References Cited

U.S. PATENT DOCUMENTS

| | | | | |
|---|---|---|---|---|
| 2006/0038736 | A1* | 2/2006 | Hui | H01Q 1/521 343/835 |
| 2009/0167615 | A1 | 7/2009 | Teng et al. | |
| 2011/0013491 | A1 | 1/2011 | Fujisawa | |
| 2011/0110529 | A1* | 5/2011 | Semcken | H04B 1/0343 381/74 |
| 2013/0057437 | A1* | 3/2013 | Chiu | H01Q 1/243 343/702 |
| 2013/0135158 | A1* | 5/2013 | Faraone | H01Q 13/10 343/702 |
| 2013/0222195 | A1* | 8/2013 | Hill | H01Q 1/243 343/725 |
| 2013/0242711 | A1 | 9/2013 | Fujisawa | |
| 2014/0062801 | A1 | 3/2014 | Yong et al. | |
| 2014/0126337 | A1 | 5/2014 | Fujisawa | |
| 2014/0266920 | A1* | 9/2014 | Tran | H01Q 1/243 343/702 |

OTHER PUBLICATIONS

Dirk Manteuffel et al., "A Concept for MIMO Antennas on Small Terminals Based on Characteristic Modes", Antenna Technology (IWAT), XP-031942761, Mar. 7, 2011, pp. 17-20.

* cited by examiner

APPARATUS FOR TUNING MULTI-BAND FRAME ANTENNA

CROSS-REFERENCE TO RELATED PATENT APPLICATIONS

The present application claims the benefit of the earlier filing date of U.S. provisional application 61/880,635 having common inventorship with the present application and filed in the U.S. Patent and Trademark Office on Sep. 20, 2013, the entire contents of which being incorporated herein by reference. In addition, the present application incorporates by reference the entire contents of U.S. patent application Ser. No. 13/962,539 having common inventorship with the present application and filed in the U.S. Patent and Trademark Office on Aug. 8, 2013.

BACKGROUND

Field of Disclosure

This disclosure relates to a multi-band frame antenna, and more specifically, to a multi-band frame antenna to be used for multiple-input multiple-output (MIMO), Global System for Mobile Communications (GSM), General Packet Radio Service (GPRS), Enhanced Data-rates for Global Evolution (EDGE), Long Term Evolution (LTE) Time-Division Duplex (TDD), LTE Frequency-Division Duplex (FDD), Universal Mobile Telecommunications System (UMTS), High-Speed Packet Access (HSPA), HSPA+, Code Division Multiple Access (CDMA), Wideband CDMA (WCDMA), Time Division Synchronous Code Division Multiple Access (TD-SCDMA), or future frequency bands.

Description of the Related Art

The "background" description provided herein is for the purpose of generally presenting the context of the disclosure. Work of the presently named inventor, to the extent it is described in this background section, as well as aspects of the description which may not otherwise qualify as prior art at the time of filing, are neither expressly nor impliedly admitted as prior art against the present invention.

As recognized by the present inventor, there is a need for a wideband antenna design with good antenna efficiency to cover Long Term Evolution (LTE), multiple-input/multiple-output (MIMO), and many other new frequency bands scheduled around the world. In a conventional wideband antenna, a plurality of ports (feeding points) of the antenna system usually correspond to a corresponding number of antenna components or elements. In a conventional two Port MIMO LTE antenna arrangement, top and bottom antennas may be a main and a sub/diversity antenna, respectively, or vice versa. The antennas are discrete antennas, optimized for performance in the frequency bands in which they were designed to operate.

The conventional wideband antenna designs do not generally meet the strict requirements in hand-head user mode (a carrier/customer specified requirement) and in real human hand mode (reality usage). These requirements have become critical, and in fact, have become the standard radiated antenna requirement set by various carriers (telecommunication companies) around the world. Hence, there is a need for a wideband antenna design with good antenna efficiency, good total radiated power (TRP), good total isotropic sensitivity (TIS) (especially in user mode, that is head-hand position), good antenna correlation, balanced antenna efficiency for MIMO system, and at the same time, good industrial metallic design with strong mechanical performance.

To make electronic devices look metallic, non-conductive vacuum metallization (NCVM) or artificial metal surface technology is conventionally used and widely implemented in the electronic device industry. A electronic device housing with a plastic frame painted with NCVM is very prone and vulnerable to color fading, cracks, and scratches.

The NCVM can cause serious antenna performance degradation if the NCVM process is not implemented properly, which has happened in many cases due to difficulties in NCVM machinery control, manufacturing process imperfections, and mishandling. Also, the appearance of NCVM does not give a metallic feeling, and looks cheap.

In order to effectively hold the display assembly of a mobile device, the narrow border of the display assembly requires a strong mechanical structure such as a ring metal frame. Conventional antennas for smartphones and other portable devices do not generally react well in the presence of a continuous ring of surrounding metal, as the metal negatively affects the performance of these antennas. Therefore, a continuous ring of metal around a periphery of a device is generally discouraged as it is believed to distort the propagation characteristics of the antenna and distort antenna patterns.

In one conventional device, a discontinuous series of metal strips are disposed around the electronic device to form different antenna segments. The strips are separated by a series of 4 slots, so that there is not a continuous current path around the periphery of the device. Each segment uses its own dedicated feed point (antenna feed, which is the delivery point between transmit/receive electronics and the antenna). This design uses multiple localized antennas with corresponding feed points. Each segment serves as one antenna, and requires at least one slot or two slots on the segment. Each segment acts as a capacitive-fed plate antenna, a loop antenna, or a monopole antenna. The difference between this design and a flexfilm/printing/stamping sheet metal antenna is that these antenna segments surround the outer area of the electronic device, while the flexfilm/printing/stamping sheet metal antenna is inside the device and invisible to the user.

As recognized by the present inventor, a problem with the antenna segments that surround the electronic device is that when a human's hands are placed on the smartphone, the human tissue serves as a circuit component that bridges the gap between segments and detunes the antenna, thus degrading performance. Moreover, these devices are sensitive to human contact due to the several slots being in direct contact with the human hand during the browsing and voice mode and creating a hotspot being around the affected slot.

SUMMARY

This disclosure describes a multi-band frame antenna used for LTE, MIMO, and other frequency bands. The frame antenna includes a conductive block and a metallic frame with no gaps or discontinuities. The conductive block functions as a system ground and has at least one electronic component mounted on the surface. The outer perimeter of the metallic frame surrounds the conductive block, and there is a gap between the metallic frame and the conductive block. One or more antenna feeds are routed across the gap, between the metallic frame and the conductive block. One or more connections can be made across the gap, and at least one electronic element connects the conductive block to the metallic frame.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
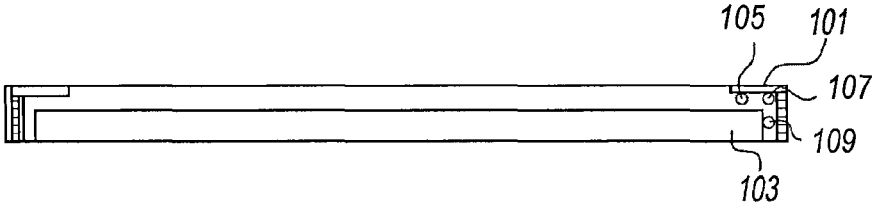
FIG. 1 is a cross-sectional view of a first embodiment of a frame antenna, according to certain embodiments.

In the drawings, like reference numerals designate identical or corresponding parts throughout the several views. Further, as used herein, the words "a," "an" and the like generally carry a meaning of "one or more," unless stated otherwise. The drawings are generally drawn to scale unless specified otherwise or illustrating schematic structures or flowcharts.

Furthermore, the terms "approximately," "about," and similar terms generally refer to ranges that include the identified value within a margin of 20%, 10%, or preferably 5%, and any values therebetween.

Aspects of the related disclosure are related to a optimizing the performance of a multi-band frame antenna. Throughout the disclosure, tuning of one or more antenna feeds is discussed. Within the disclosure, tuning can refer to any action that optimizes antenna performance or increases antenna efficiency, such as impedance matching, modifying an electrical length of an antenna, shifting a resonance frequency, removing stray resonant frequencies, and the like.

FIG. 1 is a cross-sectional view of a first embodiment of a multi-band frame antenna, according to certain embodiments. A metallic frame 101 is an annular structure that is free of complete electrical discontinuities, slits, slots or other partitions that would prohibit an electric current from traversing an entire perimeter of the metallic frame 101. The term "continuous" means that there is a continuous conductive path, even though holes or other non-conductive areas may be present in the frame. For example, the metallic frame 101 may have holes bored therethrough for providing access to an internal part of the device. The frame 101 receives a block 103 therein as will be discussed in more detail herein, so that the frame 101 surrounds a periphery of the block 103. In an alternative embodiment, the metallic frame 101 includes a pair of metallic frames in which a first frame is disposed over a second frame, and each metallic frame forms a continuous conductive loop.

Between the metallic frame 101 and block 103 are different candidate feed points 105, 107, and 109. Feed points 105, 107, and 109 are disposed in a gap between the metallic frame 101 and the block 103, and the outer perimeter of the metallic frame 101 surrounds the outer perimeter of the block 103. A vertical feed point 105 is shown with two alternatives, a horizontal feed point 109 and a tilted orientation (hybrid) feed point 107 which is placed on an inner corner and is thus half-horizontal and half-vertical. Feed points may be placed anywhere across the gap between the metallic frame 101 and block 103 with the particular locations affecting the performance as will be discussed in subsequent figures.

The block 103 contains a set of materials that are laminated together as will be discussed further herein. The components of the block 103 include the electronics and structural components of a smartphone, for example, which provides wireless communication with a remote source. While the term "block" is used, it should be understood that the block may be a plate or other object having a two-dimensional surface on which the circuit components may be mounted. In addition, the block 103 can function as the ground plane for the frame antenna, and throughout the disclosure, the terms "block" and "ground plane" can be used interchangeably.

The gap between the metallic frame 101 and the block 103 is 0.5 millimeters (mm) in this embodiment. However, the gap may be larger or smaller in some areas (typically between 0.2 and 0.9 mm), resulting in non-regular gap distance. As the size of the gap increases, the antenna performance increases. However, a larger antenna may not be easily accommodated in a small smartphone or other electronic device that requires the use of an antenna. A variety of non-conductive loading (dielectric) materials may be used to fill the gap, such as air, plastic, glass and so on.

Along the metallic frame 101, holes may be present to allow electronic interface connectors such as USB, HDMI, buttons, audio plugs, to pass therethrough.

The metallic frame 101 is shown as a conductive rectangular-shaped path but may also be of a non-rectangular shape, such as circular or a rounded shape, so as to accommodate a periphery of the electronic device on which it is used. The shape may have rounded corners or tapered corners or any other shape as long as it is a conductively continuous metal frame. The block 103, too, may have a non-rectangular shape, although a periphery of the block 103 should generally follow that of the metallic frame 101 so as to not have too large of a gap between the two. Moreover, the outer perimeter of the metallic frame 101 generally surrounds a periphery of the block 103.

Figure 2A:
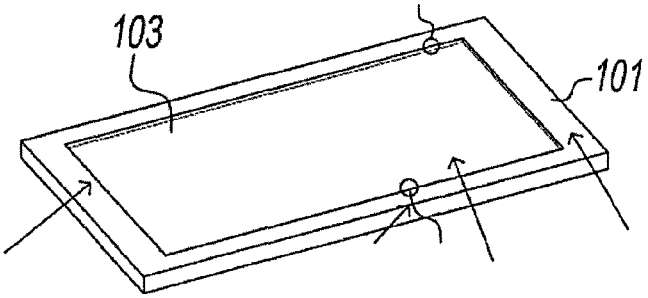
FIG. 2A is a perspective view of the frame antenna, according to certain embodiments.

FIG. 2A is a perspective view of the multi-band frame antenna, according to certain embodiments. There may be ground connections in these configurations (between the metallic frame 101 and the block 103) as will be discussed. Antenna feeds, which can include a main antenna feed and secondary antenna feed, can be positioned along the metallic frame 101. Various performances as a function of feed point locations and installed filter networks, parasitic radiators, and the like will be discussed in reference to subsequent figures. According to certain embodiments, the metallic frame 101 can overlap an upper surface of the block 103.

Figure 2B:
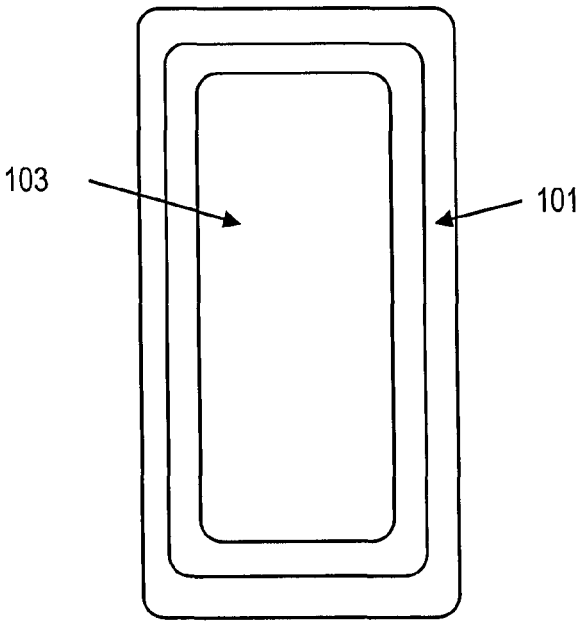
FIG. 2B is an exemplary illustration of the frame antenna, according to certain embodiments.

FIG. 2B is an exemplary illustration of the frame antenna, according to certain embodiments. In an implementation, the metallic frame 101 is arranged around the periphery of the block 103 such that a height from an upper surface to a lower surface of the metallic frame 101 is equal to a distance from an upper surface to a lower surface of the conductive block 103. In addition, the upper surface of the metallic frame 101 and the upper surface of the conductive block 103 can be parallel across a horizontal plane.

Figure 3A:
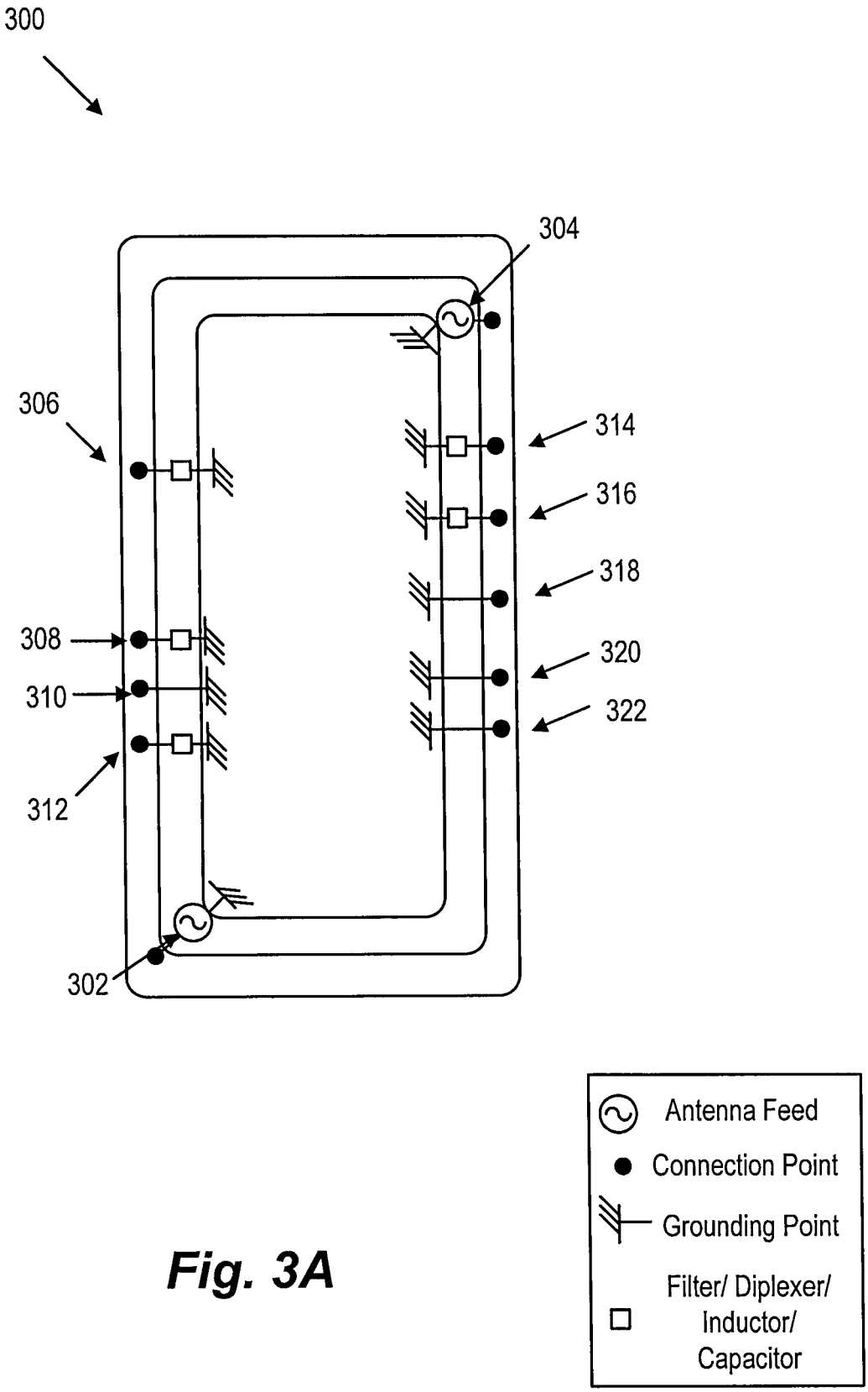
FIG. 3A is an exemplary illustration of grounding locations for a frame antenna, according to certain embodiments.

FIG. 3A is an exemplary illustration of grounding locations for a multi-band frame antenna, according to certain embodiments. Electronic device 300 can be equipped with the metallic frame 101. Main antenna feed 302 is used for the main antenna (cellular communications) and can cover the frequency bands of a main antenna. Secondary antenna feed 304 can be used as a sub, or diversity antenna, and vice versa and can cover the sub-antenna or diversity antenna frequency bands. The main antenna feed 302 and the secondary antenna feed 304 are connected to the metallic frame 101. In some embodiments, a non-cellular antenna feed can cover non-cellular bands such as BLUETOOTH, GPS, Glonass, and WLAN 2.4/5.2a, b, c. Other possibilities for feed combinations exist that can include a two feed configuration where both feeds are metallic frame feeds, and one feed is used for the main antenna and GPS, while the other feed is used for the sub antenna, BLUE TOOTH, and WLAN 2.4/5 GHz. In another two feed configuration, one feed is a metallic frame feed used for the main antenna, while the other feed is a metallic frame for a flexible plastic substrate feed, and is used for the sub antenna, BLUETOOTH, WLAN 2.4/5 GHz, and GPS.

For an electronic device that does not require a sub antenna, a single feed may be used for both the main and the non-cellular antenna, or two feeds may be used, one for the main antenna and one for the non-cellular antenna. If a single feed is used, a diplexer can be installed to direct the electrical signals of a designated frequency band to and from the metallic frame 101.

The combination of a main antenna and a sub antenna that covers all frequency bands (including LTE or future bands) may create a MIMO system.

The metallic frame 101 of an exemplary electronic device 300 has dimensions of 144 mm (vertical length)×74 mm (horizontal length)×8.5 mm (thickness), but the dimensions of the electronic device 300 can vary in other implementations as will be discussed further herein. In addition, grounding points 306, 308, 310, 312, 314, 316, 318, 320, and 322 are positioned between the metallic frame 101 and the block 103 and are connected by electronic connection points at locations around the periphery of the metallic frame 101. The locations and number of antenna feeds and grounding points are exemplary and can be varied based on the dimensions of the electronic device 300, integration of electronic and mechanical components, surrounding environment, frequency band optimizations, and the like.

Active switching components, such as single pole, double throw (SPDT) switches and the like, can be connected to the grounding points such that when the switch is in an "on" position, the grounding point is connected to the metallic frame 101, and when the switch is "off," the grounding point is disconnected from the metallic frame 101. Electronic elements, such as matching networks, filter networks, and switching components, can be connected to the grounding points and/or antenna feeds, according to certain embodiments. Details regarding the matching networks, filter networks, and switching components are discussed further herein.

Figure 3C:
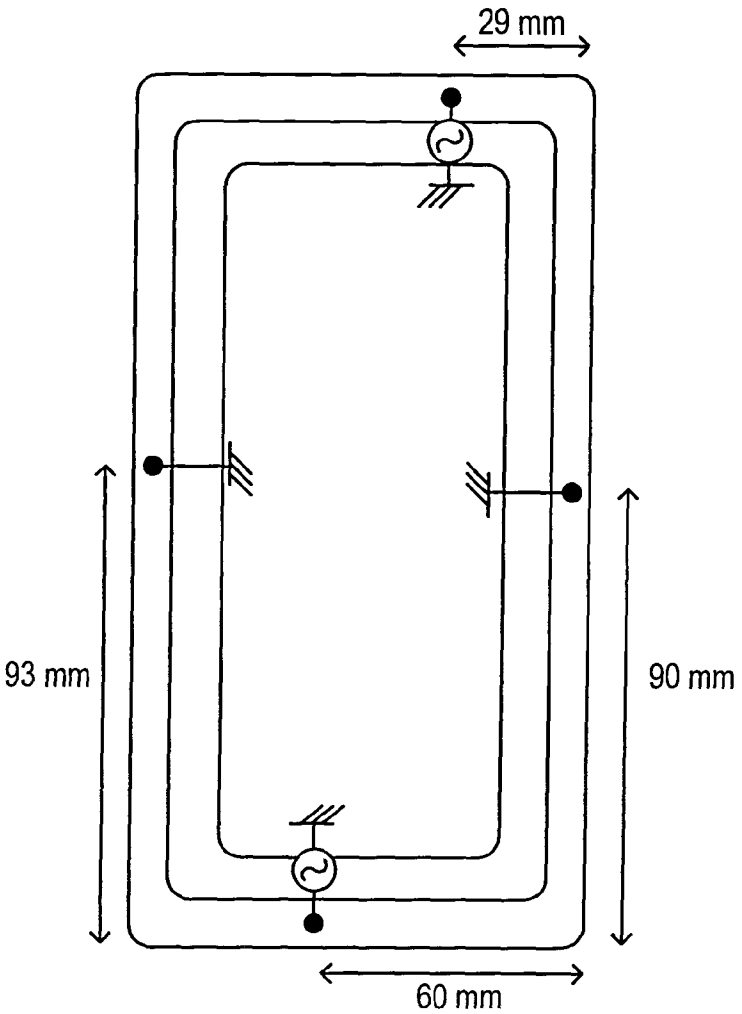
FIGS. 3B-3F are exemplary illustrations of dimensions of metallic frames with locations of antenna feeds and grounding points, according to certain embodiments.
Figure 3B:
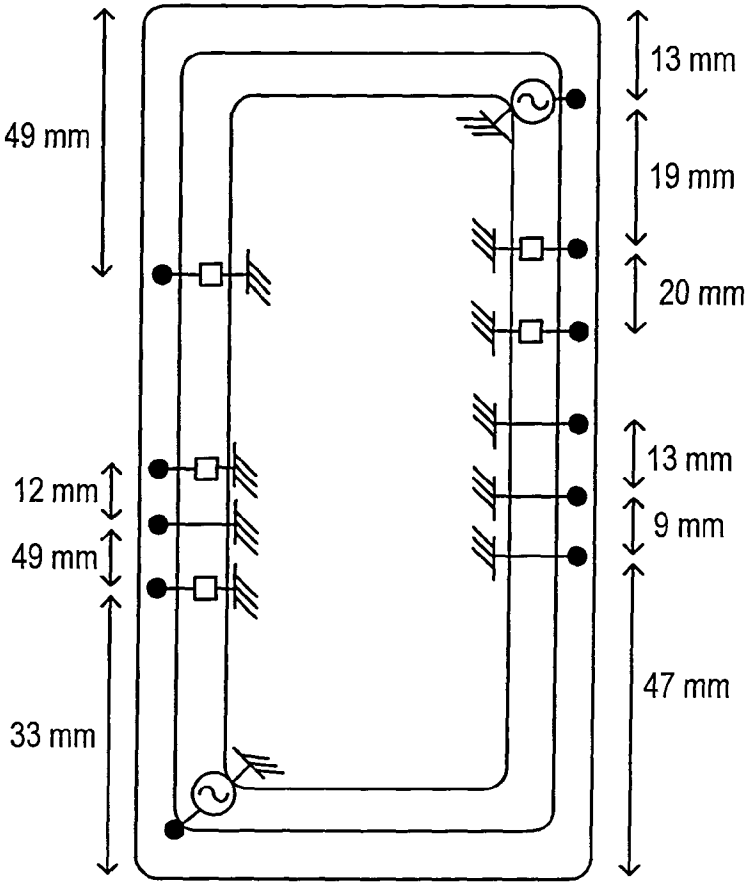
Figure 3D:
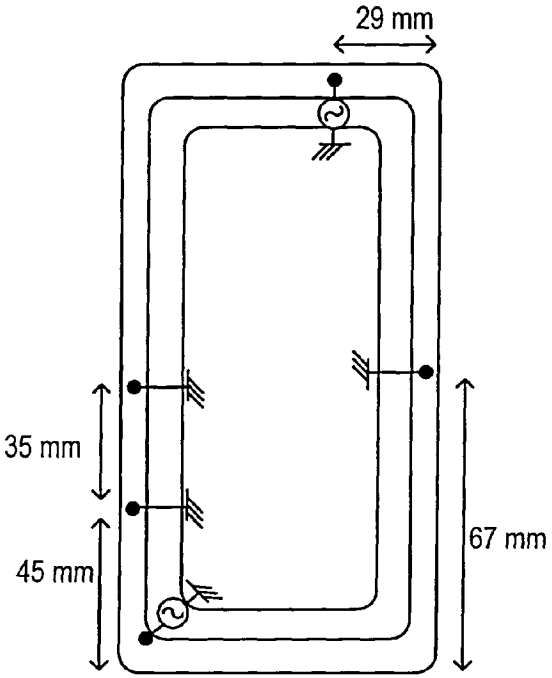
Figure 3E:
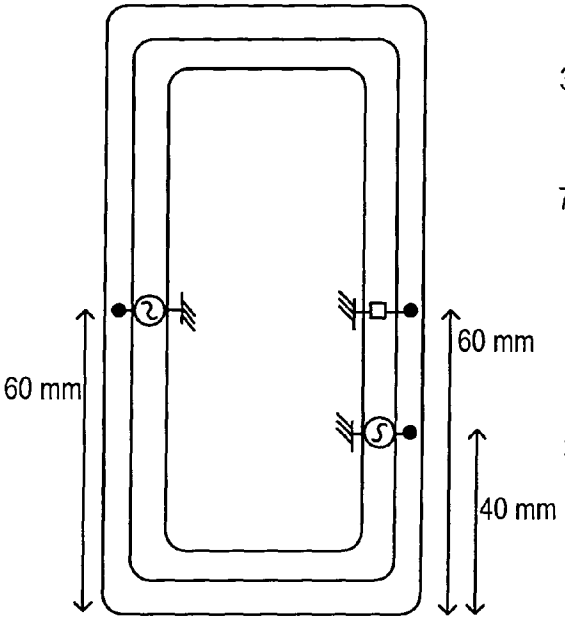
Figure 3F:
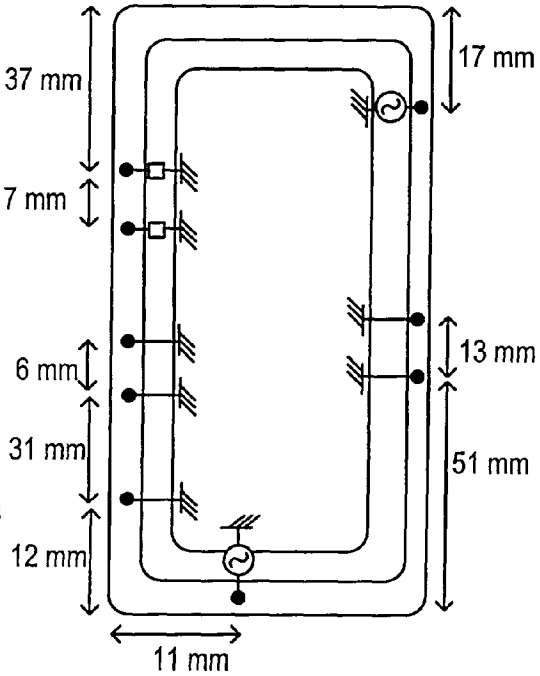

FIGS. 3B-3F are exemplary illustrations of dimensions of metallic frames with locations of antenna feeds and grounding points, according to certain embodiments. FIG. 3B illustrates exemplary locations of antenna feeds and grounding points for a metallic frame 101 with the dimensions of 144 mm×74 mm×8.5 mm. FIG. 3C illustrates exemplary locations of antenna feeds and grounding points for a metallic frame 101 with the dimensions of 176 mm×89 mm×6.2 mm. FIG. 3D illustrates exemplary locations of antenna feeds and grounding points for a metallic frame 101 with the dimensions of 160 mm×84 mm×6.5 mm. FIG. 3E illustrates exemplary locations of antenna feeds and grounding points for a metallic frame 101 with the dimensions of 120 mm×50 mm×9.4 mm. FIG. 3F illustrates exemplary locations of antenna feeds and grounding points for a metallic frame 101 with the dimensions of 127 mm×65 mm×9.5 mm.

Figure 5:
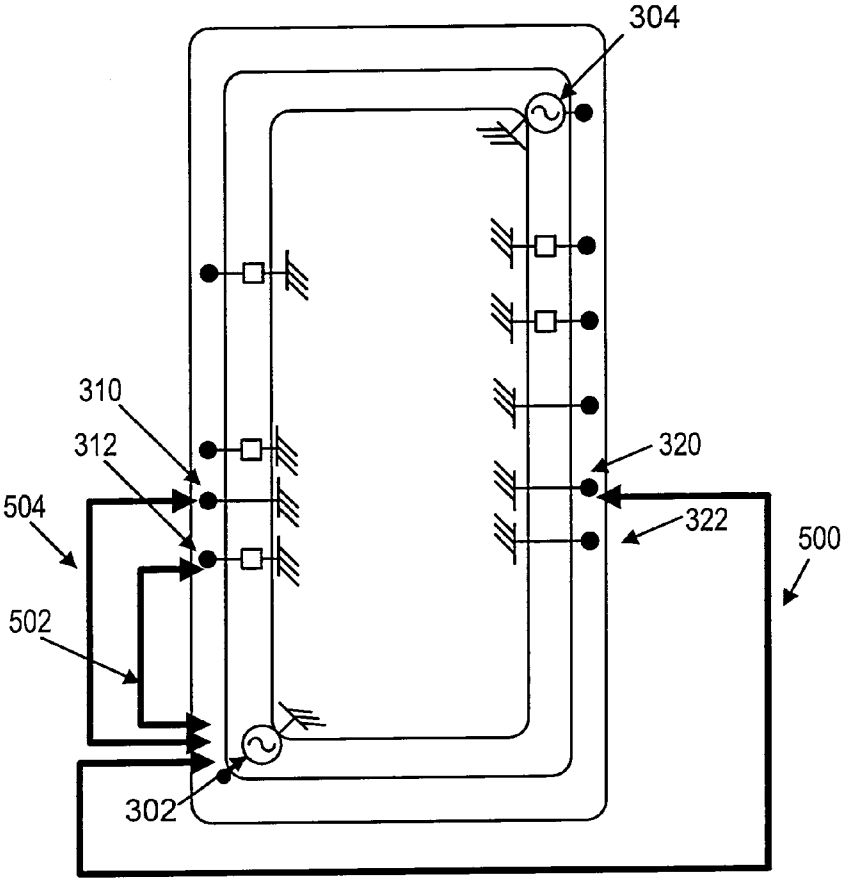
FIGS. 4 and 5 are exemplary illustrations of signal paths of a main antenna feed, according to certain embodiments.
Figure 4:
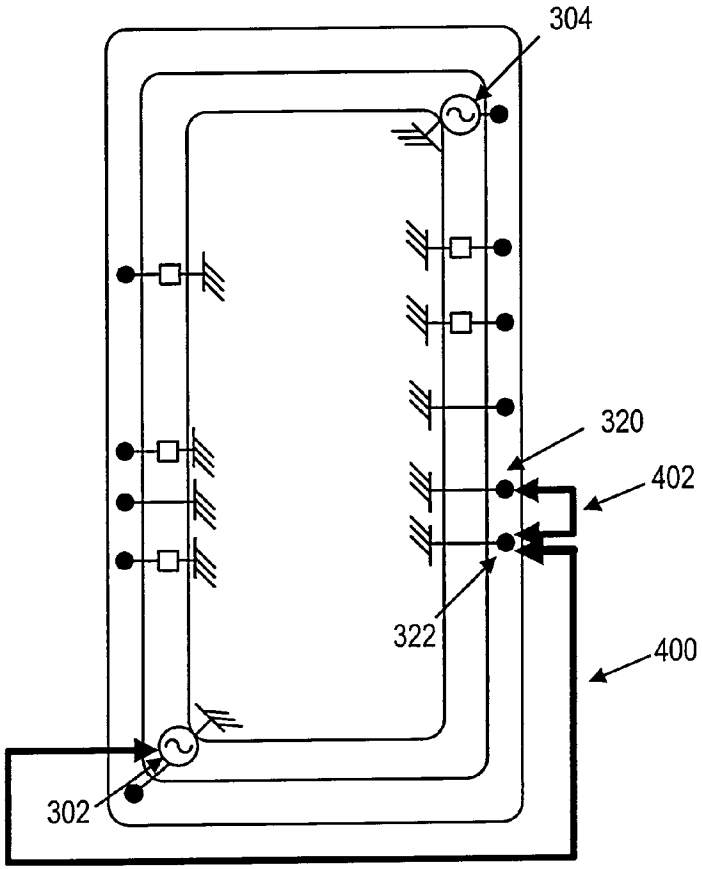

FIGS. 4 and 5 are exemplary illustrations of signal paths of a main antenna feed 302, according to certain embodiments. In FIG. 4, signal path 400 connects the main antenna feed 302 to the grounding point 322. In the example, the grounding point 322 includes a direct connection without a filter network, which allows signals in both low frequency bands and high frequency bands to pass through. In certain embodiments, the low frequency bands can include frequencies between 700 MHz and 960 MHz, and the high frequency bands can include frequencies between 1.4 GHz and 2.7 GHz. In addition, the electrical length of the signal path 400 can be approximately to equal a resonance length for both the low and high frequency bands, which can be a quarter wavelength, half wavelength, and the like.

In some implementations, grounding points 316, 318, and 320 are used to ensure a desired current distribution is achieved by stopping stray or undesired resonances from being transmitted so that maximum antenna efficiency can be achieved. For example, in FIG. 4, signal path 402 connects grounding point 322 and grounding point 320 in order to stop stray resonances being transmitted from the main antenna feed 302 through the signal path 400.

In some embodiments, the electrical length for a signal path may not be optimized for one or more frequency bands. For example, an electronic device using LTE technology may have Channels 7 and 21 as communications bands. If one of the electrical lengths from the antenna feed to the grounding point is not optimized for both Channel 7 and Channel 21, additional components such as filters, switches, diplexers, lumped components, and the like can be connected to the grounding points in order to optimize the antenna performance for one or more specific frequency bands.

FIG. 5 illustrates additional signal paths for the main antenna feed 302. For example, signal path 500 connects the main antenna feed 302 to the grounding point 320. Signal path 502 connects the main antenna feed 302 to the grounding point 312 and includes a filter network connected to the grounding point 312. Signal path 504 connects the main antenna feed 302 to the grounding point 310. The signal paths described with respect to FIG. 4 and FIG. 5 are merely exemplary and do not limit the number of possible signal paths that can be exhibited for the electronic device 300. In addition, the signal paths for the secondary antenna feed 304 connect the secondary antenna feed 304 to one or more of the grounding points on the metal frame 101.

Figure 6:
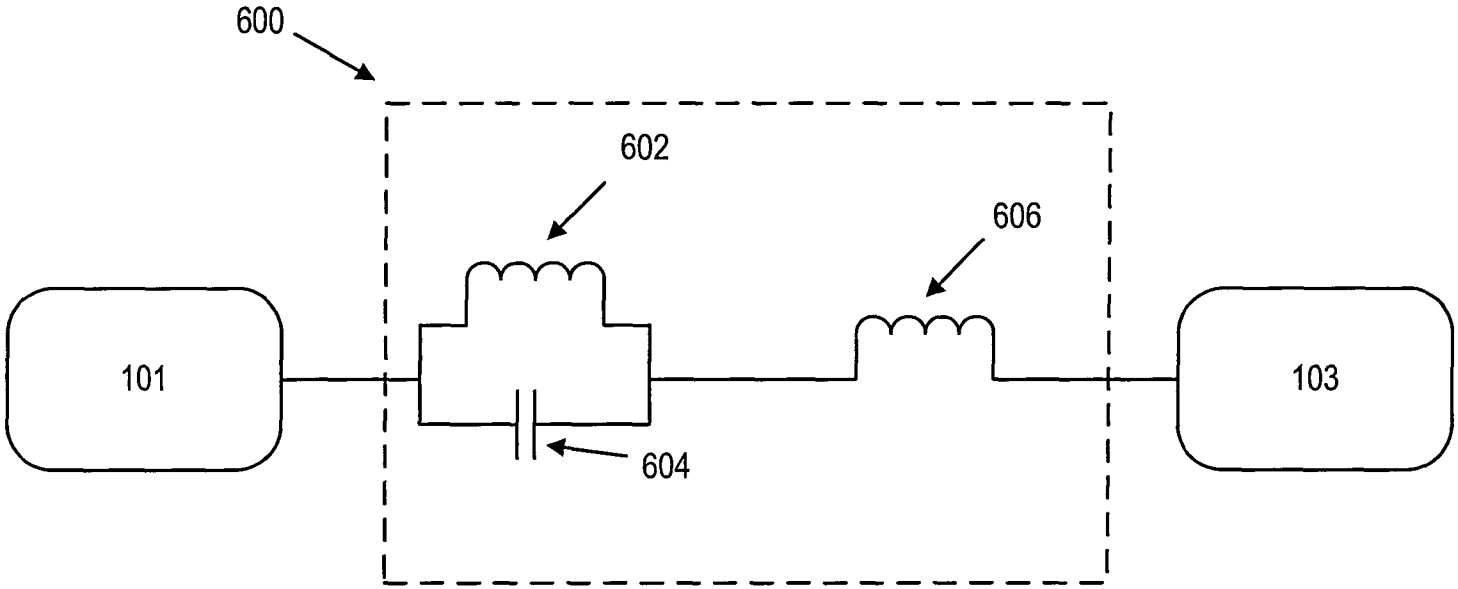
FIG. 6 is an exemplary illustration of a high band-pass filter network, according to certain embodiments.

FIG. 6 is an exemplary illustration of a high band-pass filter network 600, according to certain embodiments. The high band-pass filter network 600 includes a parallel capacitor 604 and inductor 602 connected to a series inductor 606. The metal frame 101 is connected to one terminal of the high band-pass filter network 600, and the other terminal is connected to the block 103, through a flexible plastic substrate, such as flex-film, or printed circuit board (PCB). The effects of varying the capacitor and inductor component values are discussed further herein. In addition, the component values and configuration of the high band-pass filter network 600 are exemplary, and additional filter network and lumped component network configurations can be included based on the transmitted frequency bands and applications of the multi-band frame antenna.

Figure 8:
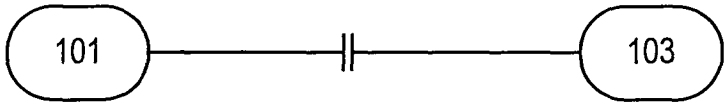
FIG. 8 is an exemplary illustration of a single capacitor loading network, according to certain embodiments.
Figure 7:
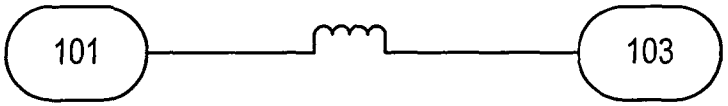
FIG. 7 is an exemplary illustration of a single inductor loading network, according to certain embodiments.
Figure 9:
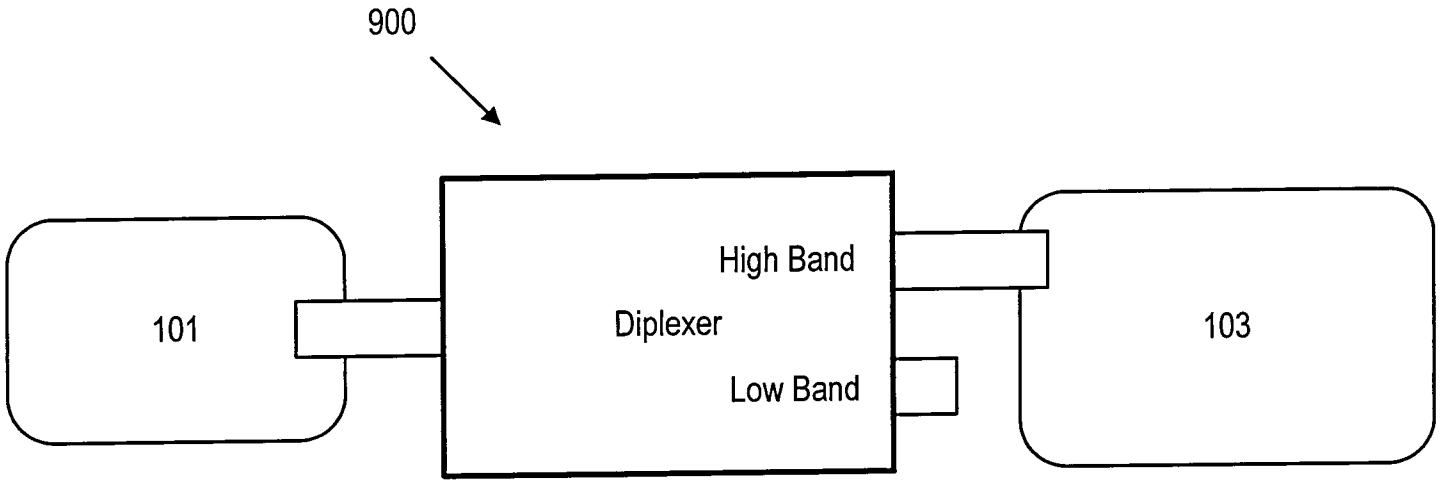
FIG. 9 is an exemplary illustration of a high pass diplexer loading network, according to certain embodiments.

FIG. 7 is an exemplary illustration of a single inductor loading network, according to certain embodiments. The metallic frame 101 is connected to one terminal of the single inductor loading network, and the other terminal is connected to the block, through the flexible plastic substrate or PCB. FIG. 8 is an exemplary illustration of a single capacitor loading network, according to certain embodiments. The metallic frame 101 is connected to one terminal of the single capacitor loading network, and the other terminal is connected to the block 103, through the flexible plastic substrate or PCB. FIG. 9 is an exemplary illustration of a high pass diplexer loading network 900, according to certain embodiments. The metallic frame 101 is connected to the high pass diplexer loading network 900 by a common input. In the example of FIG. 9, signals in the high frequency band are allowed to pass through to the block 103, and signals in the low frequency band are blocked.

Figure 10:
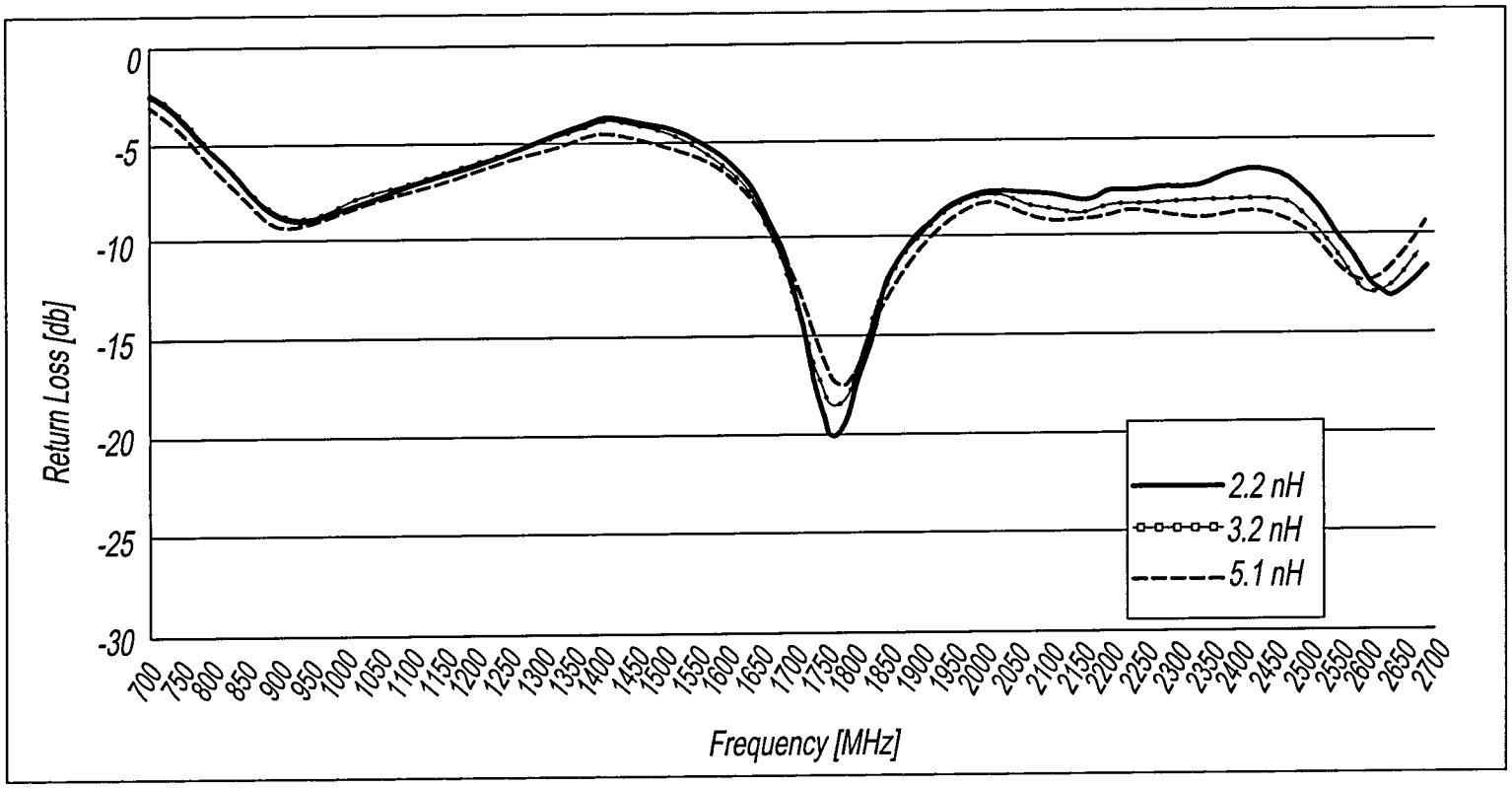
FIG. 10 is an exemplary graph of return losses for a main antenna feed loaded with an exemplary filter network, according to certain embodiments.

FIG. 10 is an exemplary graph of return losses for a main antenna feed 302 loaded with an exemplary filter network, according to certain embodiments. The exemplary filter network represented by FIG. 10 is the high band-pass filter network 600 loaded at the grounding point 312. The graph illustrates how the return losses for the main antenna feed 302 can be modified by varying the value of the series inductor 606 from 2.2 nH, to 3.2 nH, to 5.1 nH. In certain implementations, the grounding point 312 may be responsible for tuning frequencies from the main antenna feed 302 with a resonance of approximately 2.6 GHz. By modifying the value of the series inductor 606, the frequency response at 2.6 GHz can be tuned without changing the location of the grounding point 312 and maintaining the tuning of other frequency bands. One example of a frequency band with 2.6 GHz resonance is Band 7 of the LTE/UMTS bandwidth, which covers frequencies from 2.5 GHz to 2.7 GHz.

Figure 11:
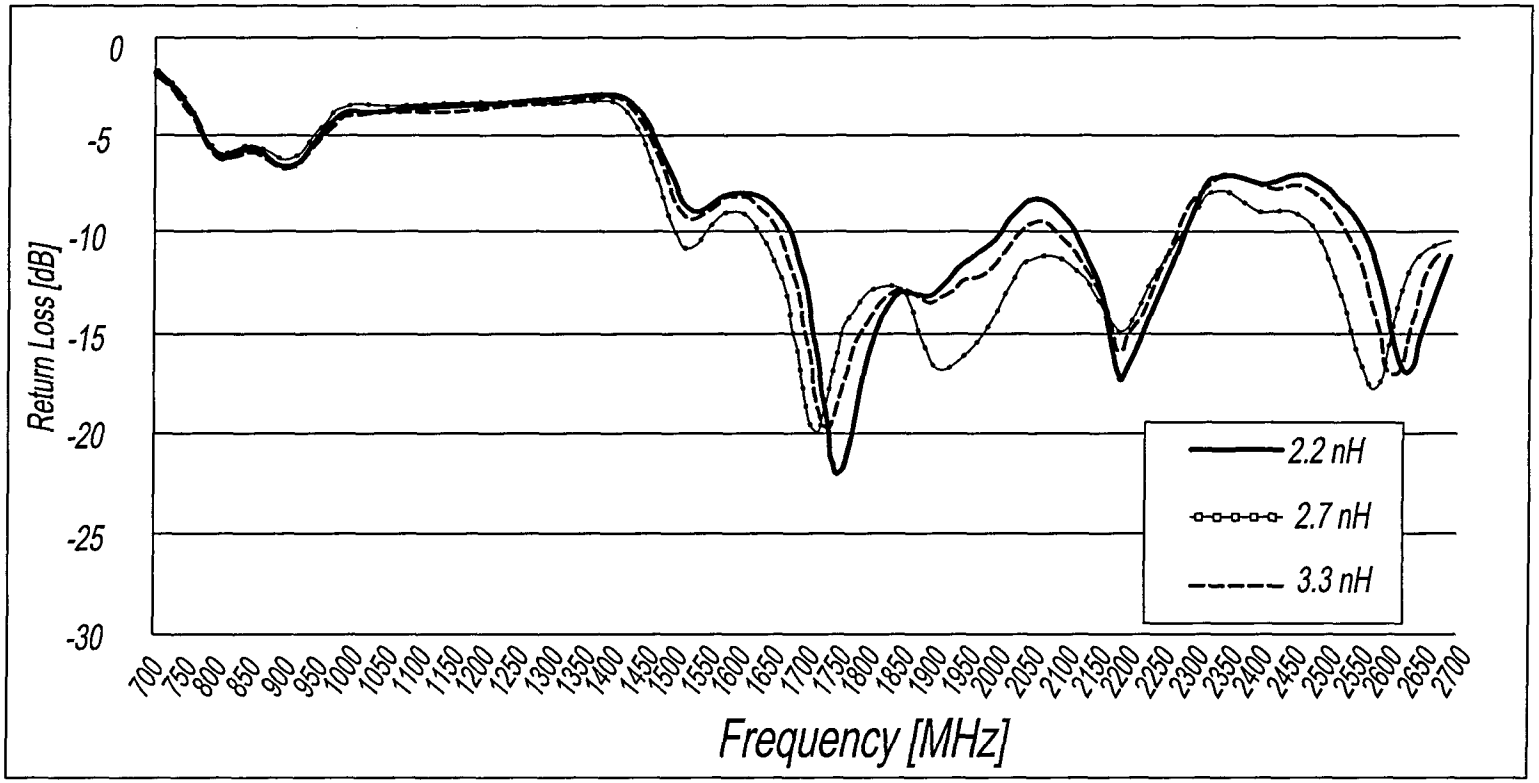
FIG. 11 is an exemplary graph of return losses for a secondary antenna feed loaded with an exemplary filter network, according to certain embodiments.

FIG. 11 is an exemplary graph of return losses for a secondary antenna feed loaded with an exemplary filter network, according to certain embodiments. The exemplary filter represented by FIG. 11 is the high band-pass filter network 600 loaded at the grounding point 314. The graph illustrates how the return losses for the secondary antenna feed 304 can be modified by varying the value of the series inductor 606 from 2.2 nH, to 2.7 nH, to 3.3 nH. In certain implementations, the grounding point 314 may be responsible for tuning frequencies from the secondary antenna feed 304 with resonance of approximately 2.6 GHz and approximately 1.75 GHz. By increasing the value of the series inductor 606, the electrical length of the secondary antenna feed 304 can be increased in order to shift the resonant frequencies to a lower value without changing the location of the grounding point 314. Examples of frequency bands that experience resonance at 2.6 GHz include LTE/UMTS Bands 7 and 38. Examples of frequency bands that experience resonance at 1.75 GHz include LTE/UMTS Band 3, DCS, PCS, and UMTS Band 4.

Figure 12:
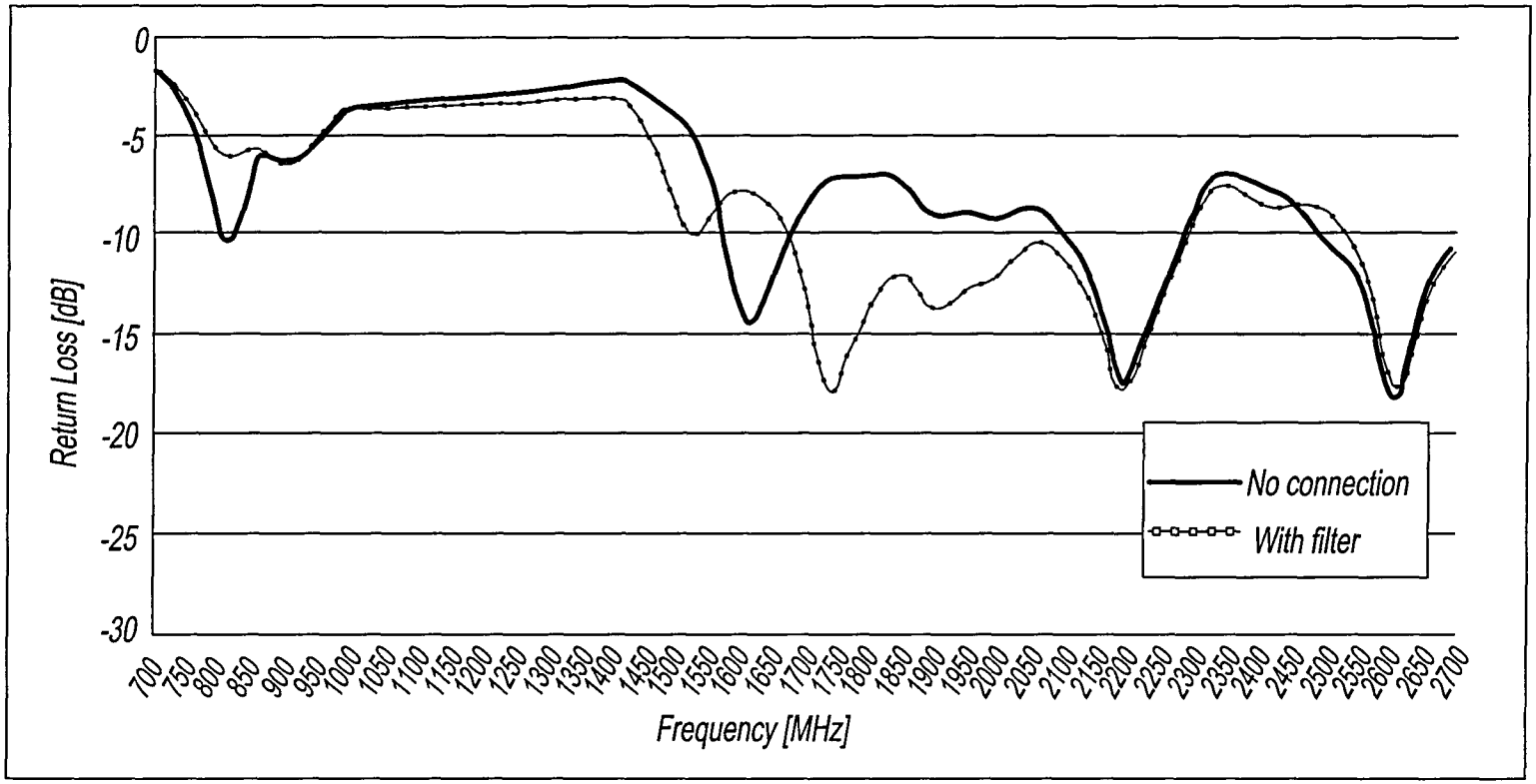
FIG. 12 is an exemplary graph of return losses for a secondary antenna feed, according to certain embodiments.

FIG. 12 is an exemplary graph of return losses for a secondary antenna feed 304, according to certain embodiments. The exemplary filter network represented by FIG. 12 is the high band-pass filter network 600 loaded at the grounding point 316. The graph illustrates the effect of having a loaded filter network, such as the high band-pass filter network 600, connected to a grounding point, versus not having additional components connected to the grounding point. For example, the graph illustrates that the loaded filter network that is connected to the grounding point 316 tunes the resonant frequencies in both the low and high frequency bands so that the resonant frequencies are different from the resonant frequencies at grounding point 316 without the loaded filter network.

In certain embodiments, parasitic radiators can be attached to one or more antenna feeds on the metallic frame 101. The length of the parasitic radiators can be varied based on the frequency bands covered by the antenna, the surrounding environment, and other electromechanical materials that are loaded into an electronic device. In some implementations, the electric length of the branch-type parasitic radiators is equal to approximately a quarter of a wavelength of the transmission signal. Parasitic radiators can be made of materials such as flexible plastic substrate, stamped sheet metal, laser direct structuring (LDS) thermoplastic materials, and the like. The parasitic radiators described herein with respect to the main antenna feed 302 can also be attached at the secondary antenna feed 304.

Figure 13B:
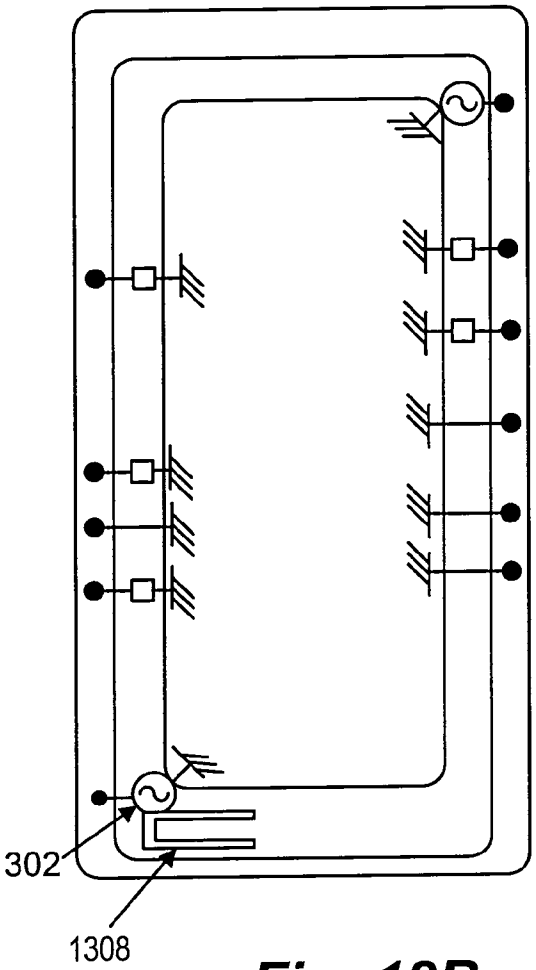
FIGS. 13A and 13B are exemplary illustrations of multi-band frame antennas with branch-type parasitic radiators, according to certain embodiments.
Figure 13A:
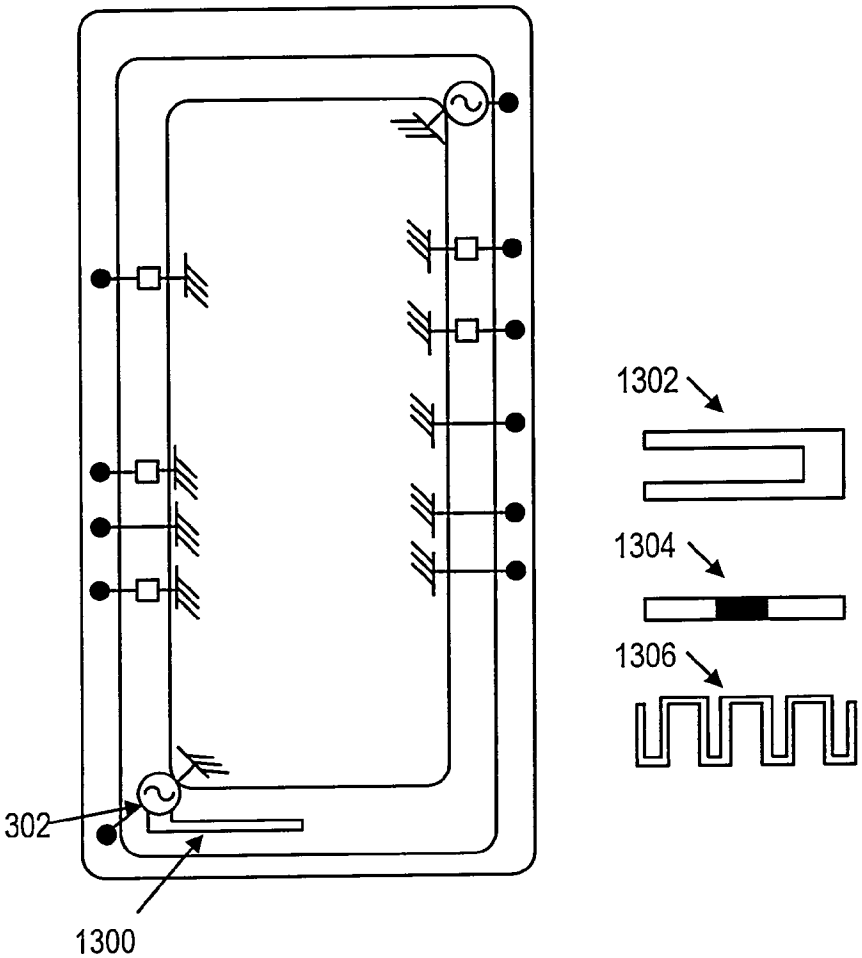

FIGS. 13A and 13B are exemplary illustrations of multi-band frame antennas with branch-type parasitic radiators, according to certain embodiments. FIG. 13A is an exemplary illustration of a single branch parasitic radiator 1300 that is attached to the main antenna feed 302. According to certain implementations, the single branch parasitic radiator 1300 can have a low-pitch meandered pattern 1302, inductor-loaded shape 1304, high-pitch meandered pattern 1306, loop shape, and the like, which allows the size of the parasitic radiator to be reduced. The shape of the single branch parasitic radiator 1300 can be determined based on the dimensions of the metallic frame 101, frequency bands covered by the antenna, and the like. FIG. 13B is an exemplary illustration of a double branch parasitic radiator 1308 that can have a low-pitch meandered pattern 1302, inductor-loaded shape 1304, high-pitch meandered pattern 1306, loop shape, and the like.

In addition, other electromechanical components installed in electronic devices such as speakers, microphones, USB connections, and the like can have decoupling components attached in order to filter out undesired frequency bands, modify resonance length, and the like. In the figures described herein, the electromechanical components are not shown in order to provide for clarity of the figures. The absence of the electromechanical components in the figures is not meant to preclude the presence of the electromechanical components in the exemplary embodiments described herein.

Figure 14:
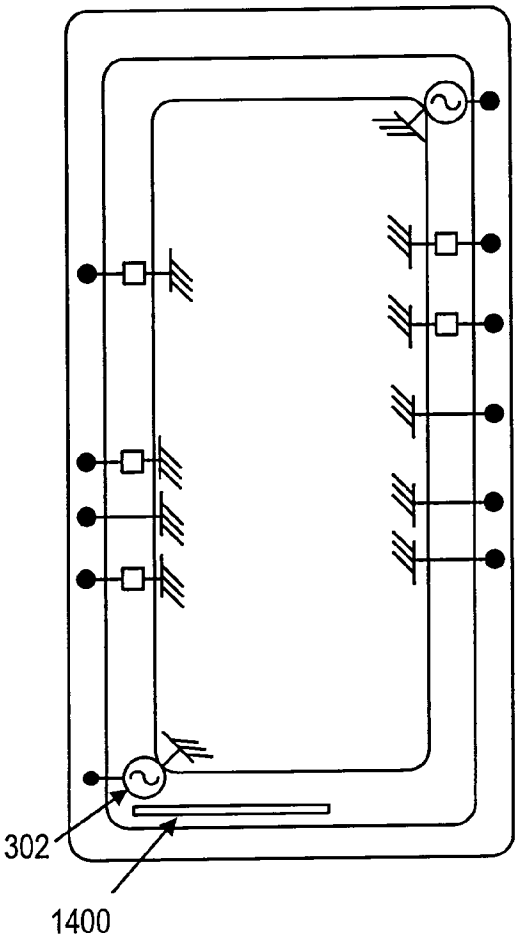
FIG. 14 is an exemplary illustration of a multi-band frame antenna with a floating-type parasitic radiator, according to certain embodiments.

FIG. 14 is an exemplary illustration of a multi-band frame antenna with a floating-type parasitic radiator 1400, according to certain embodiments. The floating-type parasitic radiator 1400 can have a low-pitch meandered pattern 1302, inductor-loaded shape 1304, high-pitch meandered pattern 1306, loop shape, and the like. In some implementations, the electric length of the floating-type parasitic radiator 1400 is longer than the branch-type parasitic radiator and is approximately a half wavelength of the transmission signal. The floating-type parasitic radiator 1400 can be unattached from an antenna feed and a ground plane, which can make installation of the floating-type parasitic radiator 1400 a simpler process than installing a parasitic radiator that is attached to an antenna feed or a ground plane.

Figure 15:
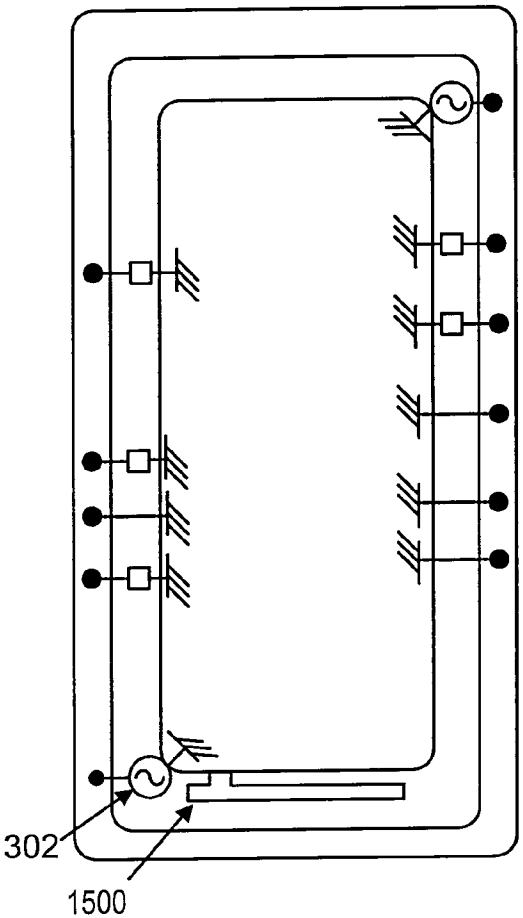
FIG. 15 is an exemplary illustration of a multi-band frame antenna with a grounded parasitic radiator extending from a ground plane, according to certain embodiments.

FIG. 15 is an exemplary illustration of a multi-band frame antenna with a grounded parasitic radiator 1500 extending from a ground plane, according to certain embodiments. The grounded parasitic radiator 1500 can have a low-pitch meandered pattern 1302, inductor-loaded shape 1304, high-pitch meandered pattern 1306, loop shape, and the like. In certain implementations, matching components, such as capacitors or inductors, and switching components can be loaded in between the grounded parasitic radiator 1500 and the block 103 in order to tune the parasitic radiator. In addition, the location of the grounding point of the grounded parasitic radiator 1500 can vary based on tuning properties of the parasitic radiator.

Figure 16:
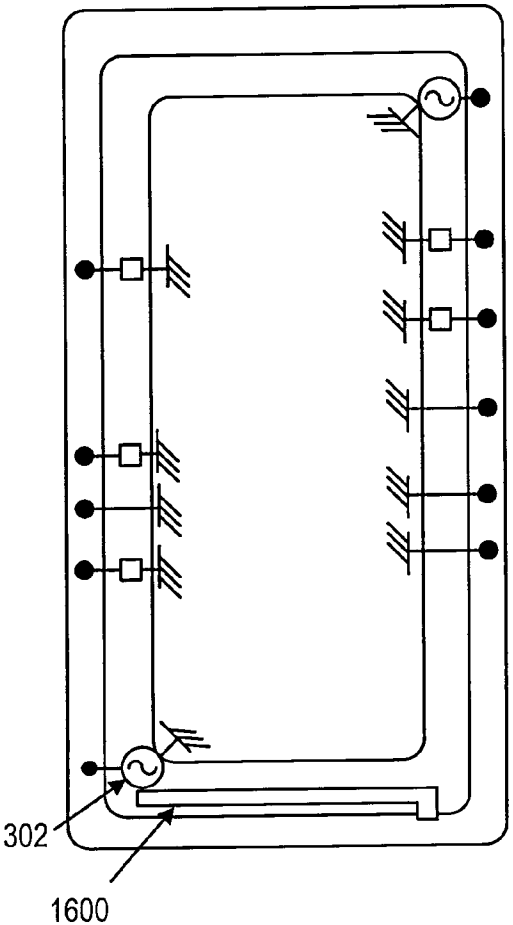
FIG. 16 is an exemplary illustration of a multi-band frame antenna with a grounded parasitic radiator extending from the metallic frame, according to certain embodiments.

FIG. 16 is an exemplary illustration of a multi-band frame antenna with a grounded parasitic radiator 1600 extending from the metallic frame 101, according to certain embodiments. The grounded parasitic radiator 1600 can have a low-pitch meandered pattern 1302, inductor-loaded shape 1304, high-pitch meandered pattern 1306, loop shape, and the like. In certain implementations, matching components, such as capacitors or inductors, and switching components can be loaded in between the grounded parasitic radiator 1600 and the ground plane in order to tune the parasitic radiator. In addition, the grounding location of the grounded parasitic radiator 1600 can vary based on tuning properties of the parasitic radiator.

Figure 17:
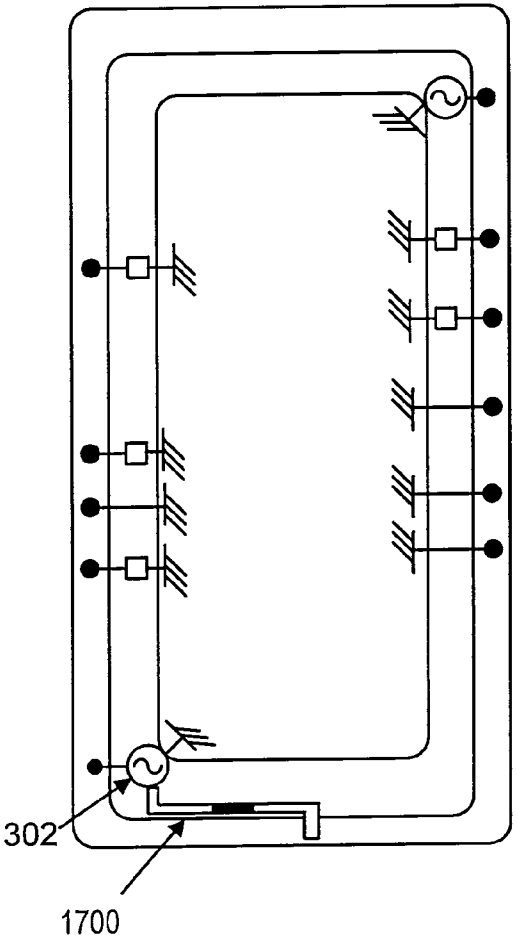
FIG. 17 is an exemplary illustration of a multi-band frame antenna with an inductor-loaded parasitic radiator connecting a main antenna feed and the metallic frame, according to certain embodiments.

FIG. 17 is an exemplary illustration of a multi-band frame antenna with a parasitic radiator 1700 connecting the main antenna feed 302 and the metallic frame 101, according to certain embodiments. The parasitic radiator 1700 connecting the main antenna feed and the metallic frame 101 can be inductor-loaded, as shown in FIG. 17, but can also have a low-pitch meandered pattern 1302, high-pitch meandered pattern 1306, loop pattern, and the like. The shape of the parasitic radiator 1700 can be straight, L-shaped, curved, or any shape that that meets that meets physical and electronic specifications of the multi-band frame antenna. The parasitic radiator 1700 can also be loaded with capacitors, switches, and other lumped components. In addition, the grounding location of the parasitic radiator 1700 on the metallic frame 101 can vary based on tuning properties of the parasitic radiator.

Figure 18:
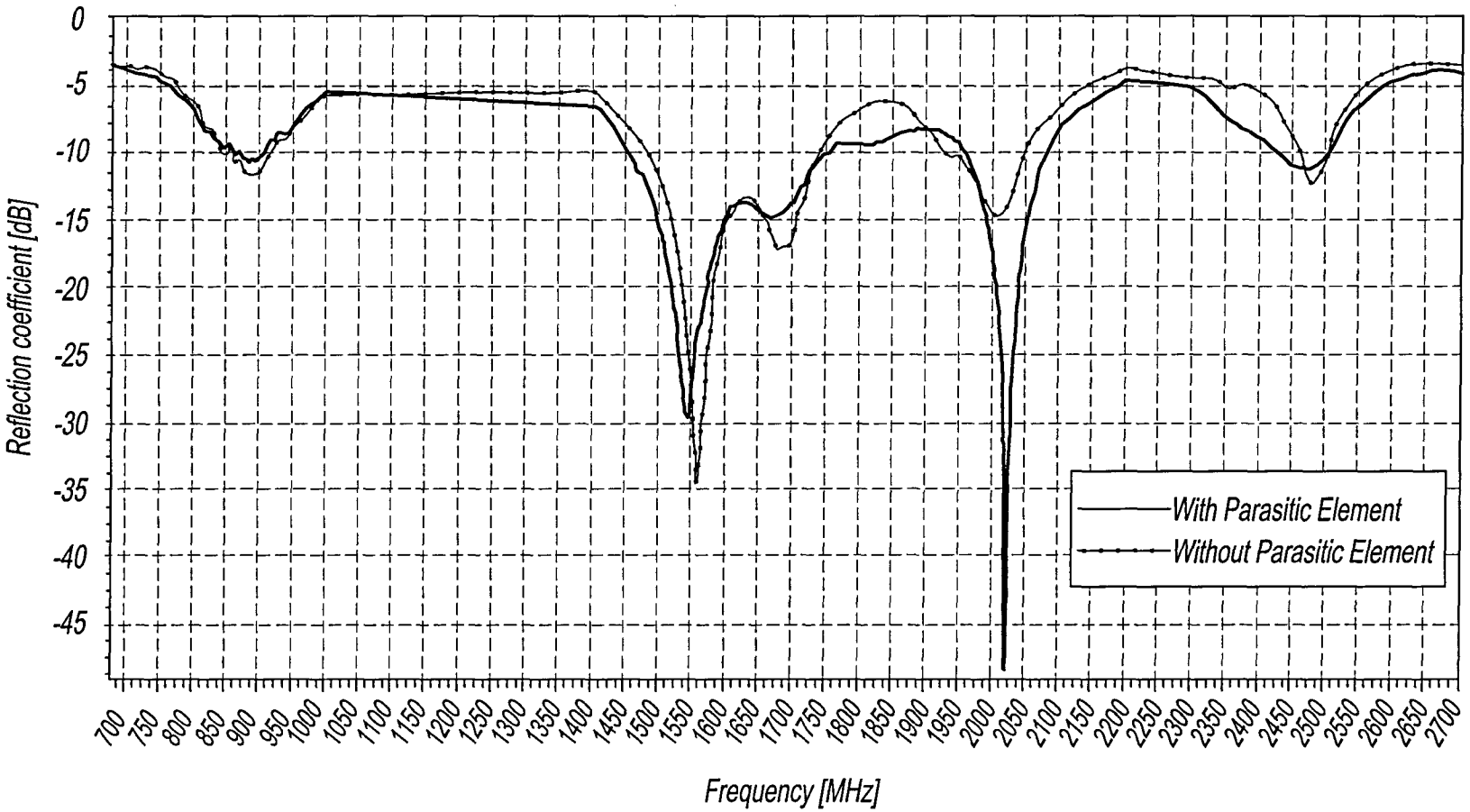
FIG. 18 is an exemplary graph of reflection coefficient of a main antenna feed with or a parasitic radiator, according to certain embodiments.

FIG. 18 is an exemplary graph of the reflection coefficient, or return losses, of a main antenna feed with an attached parasitic radiator, according to certain embodiments. The graph illustrates the reflection coefficient across a range of operating frequencies for the main antenna feed 302 with and without a parasitic radiator.

Figure 19:
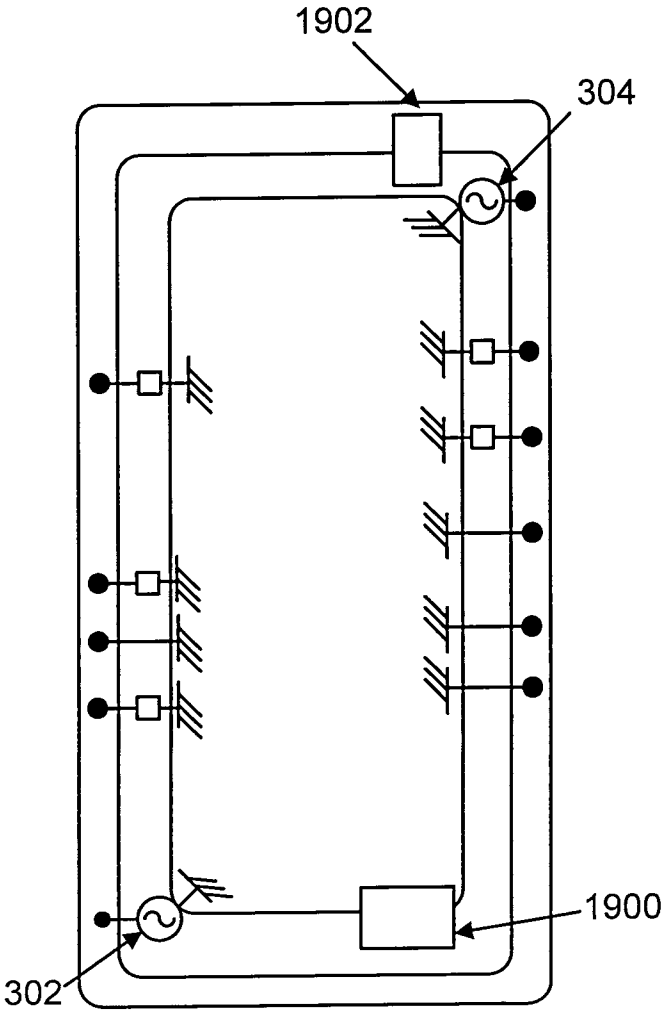
FIG. 19 is an exemplary illustration of a multi-band frame antenna with an integrated WIFI/BLUETOOTH antenna and an audio jack, according to certain embodiments.

FIG. 19 is an exemplary illustration of a multi-band frame antenna with an integrated WIFI/BLUETOOTH antenna 1900 and an audio jack 1902, according to certain embodiments. The placement, orientation, and distance between the WIFI/BLUETOOTH antenna 1900 and the metallic frame 101 can be varied based on optimizing the signal transmission and minimizing coupling between the multi-band frame antenna and the WIFI/BLUETOOTH antenna 1900. In addition, the WIFI/BLUETOOTH antenna 1900 is electrically isolated from the multi-band frame antenna. In certain embodiments, minimizing the coupling between the multi-band frame antenna and the WIFI/BLUETOOTH antenna 1900 and maximizing antenna performance can be achieved by optimizing the location of the WIFI/BLUETOOTH antenna 1900, selection of a type of antenna element, gap distance between the metallic frame 101 and the WIFI/BLUETOOTH antenna 1900, and antenna tuning. Types of antenna elements for the WIFI/BLUETOOTH antenna 1900 can include a Planar Inverted-F Antenna (PIFA), a loop antenna, a capacitive-fed antenna, a monopole antenna, an inductor-loaded antenna, and other types of antennas that are designed to function as a WIFI/BLUETOOTH antenna 1900. As will be discussed further herein, a signal line on the audio jack 1902 can function as a parasitic radiator for the multi-band frame antenna.

Figure 20:
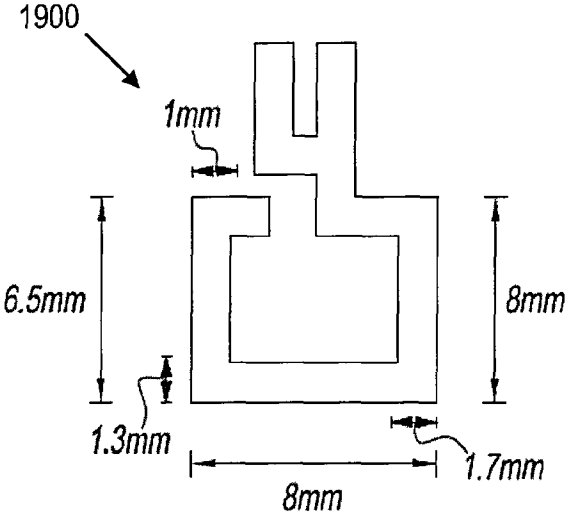
FIG. 20 is an exemplary illustration of a WIFI/BLUETOOTH antenna, according to certain embodiments.

FIG. 20 is an exemplary illustration of a WIFI/BLUETOOTH antenna 1900, according to certain embodiments. In FIG. 20, the exemplary WIFI/BLUETOOTH antenna 1900 is a meandered or spiral PIFA, but can be any other type of antenna that can function as a WIFI/BLUETOOTH antenna 1900. In addition, the dimensions of the WIFI/BLUETOOTH antenna 1900 are exemplary, according to certain embodiments, and can be varied to accommodate optimized antenna performance.

Figure 21:
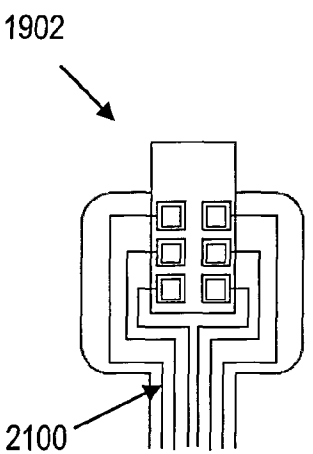
FIG. 21 is an exemplary illustration of an audio jack, according to certain embodiments.

FIG. 21 is an exemplary illustration of an audio jack 1902, according to certain embodiments. A plurality of signal lines within the audio jack 1902 can transmit audio signals, and the A-line 2100 can transmit FM/AM and/or Digital radio signals with internal/external antennas. According to certain embodiments, the A-line 2100 can also be used as a parasitic radiator or coupling element for the multi-band frame antenna. The audio jack and metallic frame can also be electrically isolated, and the audio jack 1902 can be placed at any location along the metallic frame 101 to optimize antenna performance. In addition, other signal lines such as speaker lines, microphone lines, can be selected as band stop filters for one or more cellular, GPS, WIFI, and/or BLUETOOTH frequency bands.

Figure 22:
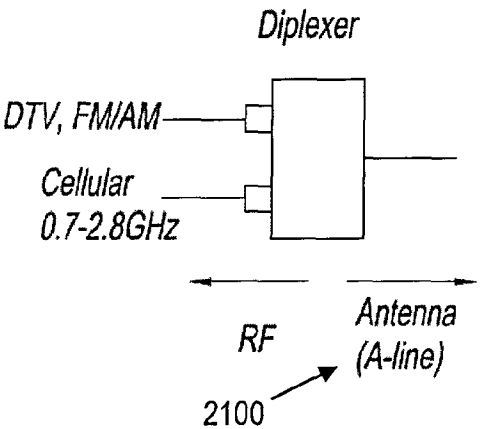
FIG. 22 is an exemplary illustration of how an A-line of an audio jack can be integrated with a diplexer, according to certain embodiments.

FIG. 22 is an exemplary illustration of how an A-line 2100 of an audio jack 1902 can be integrated with a diplexer, according to certain embodiments. According to one implementation, the A-line 2100 can function as a cellular or non-cellular antenna feed in addition to the main antenna feed 302, secondary antenna feed 304, and any other antenna feed installed on the metallic frame 101. The diplexer can be used to split the signal on the A-line that is being shared between the FM/AM/digital radio signal and the additional cellular or non-cellular antenna feed. In the example of FIG. 22, the A-line can be used as an antenna for cellular communication signals with frequencies from 0.7 GHz to 2.8 GHz as well as the FM/AM/digital radio signal for the audio jack 1902.

Figure 23:
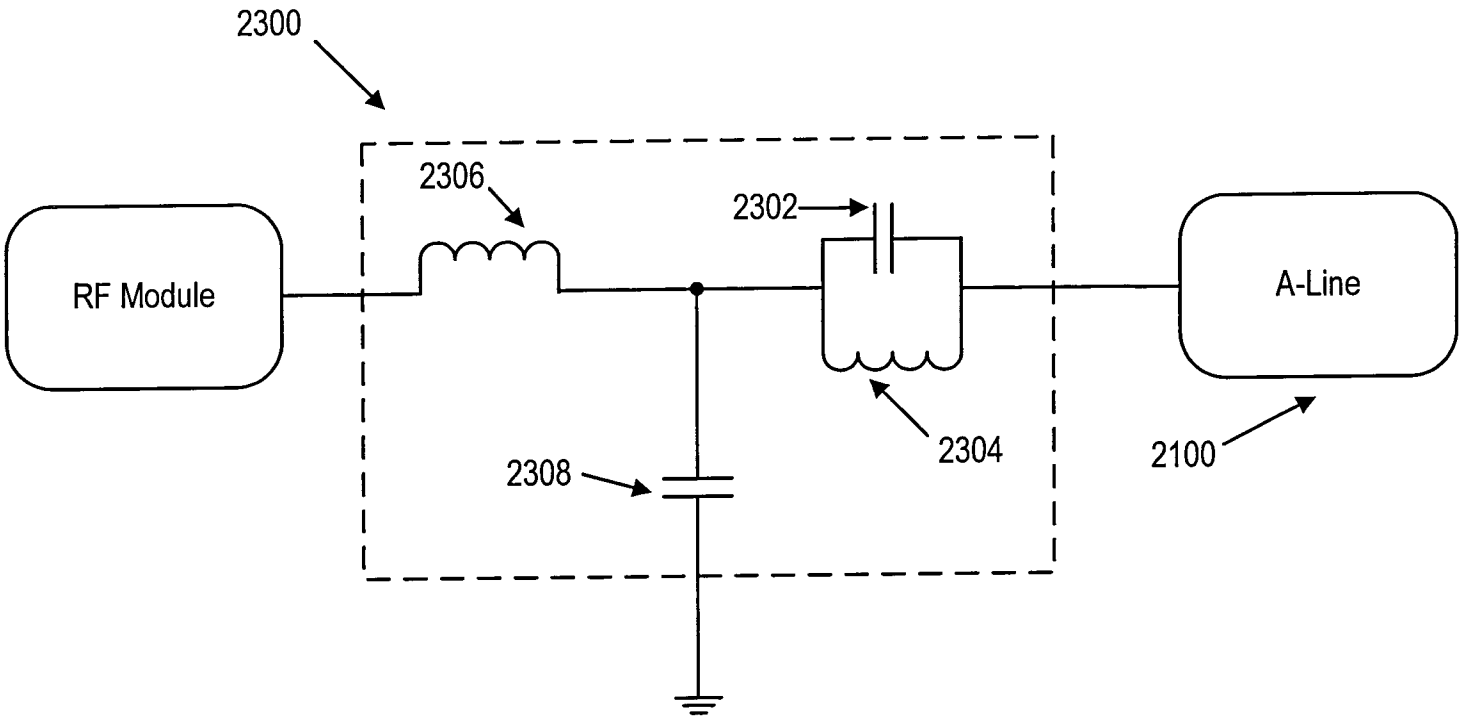
FIG. 23 is an exemplary illustration of a filter network connected to an A-line of an audio jack, according to certain embodiments.

FIG. 23 is an exemplary illustration of a filter network 2300 connected to the A-line 2100 of an audio jack 1902, according to certain embodiments. The filter network 2300 can include a parallel capacitor 2302 and inductor 2304 connected to a series inductor 2306 with an additional capacitor 2308 connected to ground. In the present disclosure, the grounding lines for the A-line 2100 are not shown to provide a more concise description and illustration. In some implementations, the filter network 2300 can also be a matching network or a phase shifter in order to provide for antenna optimization. The values of the filter network components can be varied based on the desired output. In one example, the values of the components in the filter network 2300 can be 1.1 pF for capacitor 2302, 2.7 nH for inductor 2304, 10 nH for inductor 2306, and 5.1 pF for capacitor 2308. The A-line 2100 of the audio jack 1902 can be connected to an RF module through the filter network 2300 in order to tune transmission signals from an antenna feed to designated frequencies.

Figure 24:
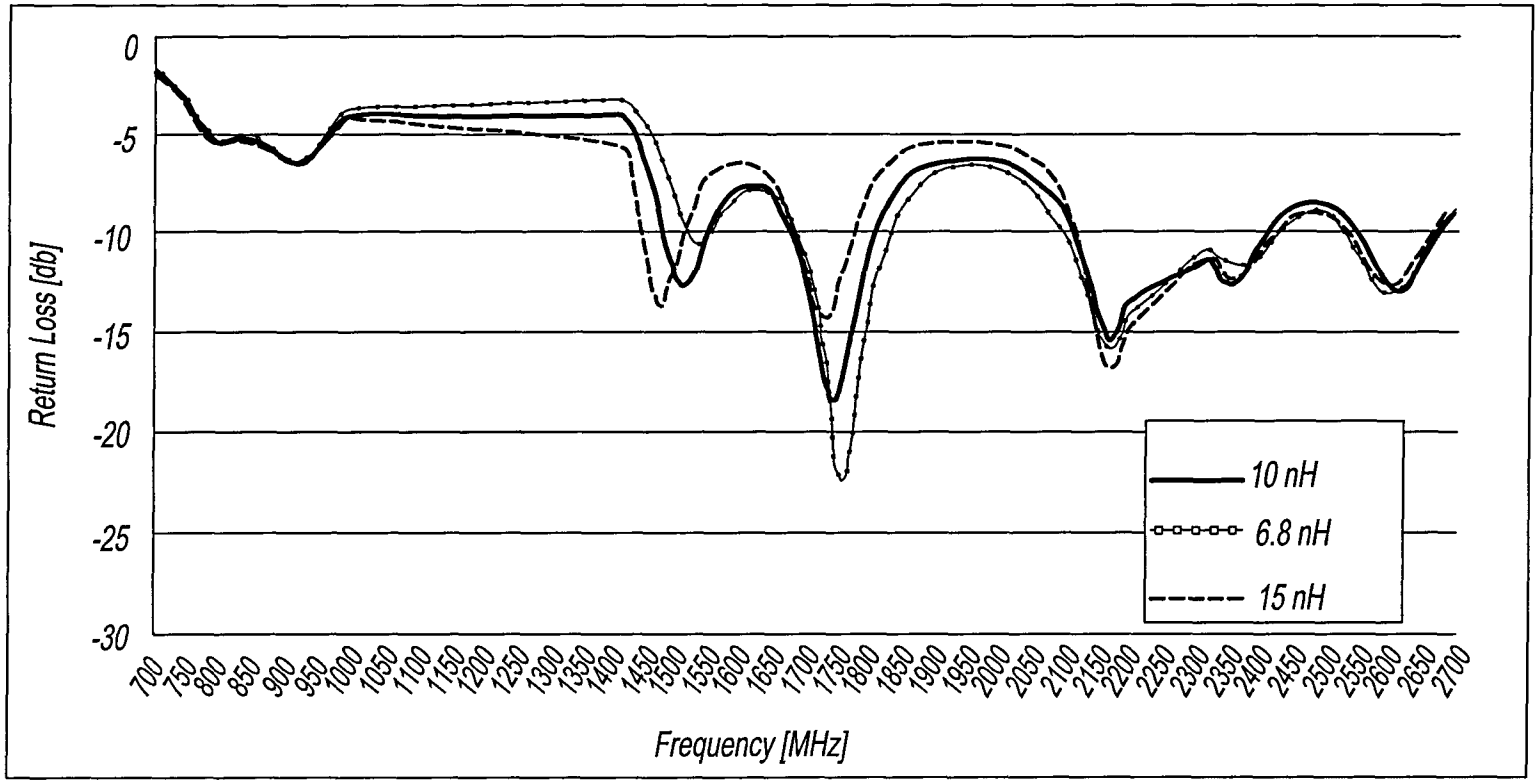
FIG. 24 is an exemplary graph of return losses of a secondary antenna with an A-line integrated with filter network components, according to certain embodiments.

FIG. 24 is an exemplary graph of return losses for a secondary antenna 304 with an A-line 2100 integrated with filter network components, according to certain embodiments. The exemplary filter represented by FIG. 24 is the filter network 2300 connected to the A-line 2100 of an audio jack 1902. The graph illustrates how the return losses for the secondary antenna feed 304 can be modified by varying the value of the parallel inductor 2306 from 10 nH, to 6.8 nH, to 15 nH. In addition, capacitor 2302 has a value of 1.5 pF, inductor 2304 has a value of 2.7 nH, and capacitor 2308 is removed in the example illustrated in FIG. 24. In certain embodiments, the values of capacitor 2302, capacitor 2308, and inductor 2304 can also be varied to adjust the tuning of the secondary antenna feed 304. As is shown in the graph of FIG. 24, the A-line 2100 along with filter network 2300 may be responsible for tuning frequencies from the secondary antenna feed 304 with resonance of approximately 1.75 GHz and GPS frequencies of approximately 1.575 GHz. By increasing the value of the parallel inductor 2306, the electrical length of the secondary antenna feed 304 can be modified in order to shift the resonant frequencies of approximately 1.75 GHz and 1.575 GHz without affecting lower band and higher band frequencies, such as LTE/UMTS Bands 1 and 7.

Figure 25A:
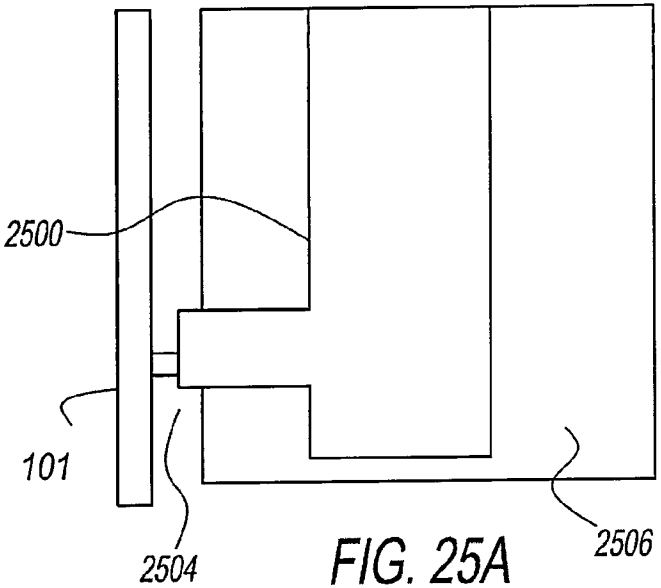
FIGS. 25A and 25B illustrate an exemplary feeding and grounding connection mechanism that uses flexible plastic substrate and a horizontal grounding contact, according to certain embodiments.
Figure 25B:
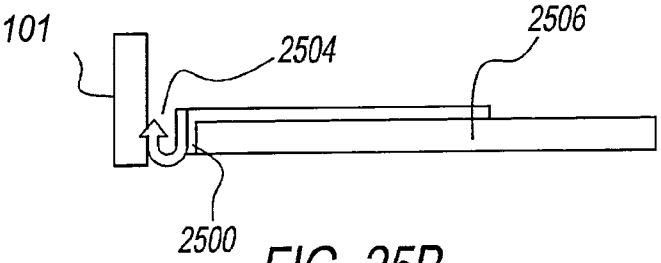

FIGS. 25A, 25B, 26A, and 26B are exemplary illustrations of feeding and grounding connection mechanisms in a multi-band frame antenna. FIGS. 25A and 25B illustrate an exemplary feeding and grounding connection mechanism that uses a flex-film layer 2500 and a horizontal grounding contact 2504, according to certain embodiments. FIG. 25A illustrates a top view, and FIG. 25B illustrates a cross-sectional view of the feeding and grounding connection mechanism. In the example of FIGS. 25A and 25B, only one grounding location is shown. In some implementations, an antenna feed can be grounded at a point but can also be grounded at a larger area, such as at a ground plane of a component, such as the PCB. FIGS. 25A and 25B illustrate the metallic frame 101 connected to the display and supporting structures 2506 via a horizontal connector 2504, which can be a spring or other type of horizontal connector. The horizontal connector 2504 can be supported by a flex-film layer 2500 or any other supporting plastic or molding material. Any matching networks, filter networks, inductors, capacitors, diplexers, switches, or the like that are used for antenna tuning as discussed previously can be installed on the flex-film layer 2500 and/or the display and supporting structures 2506.

Figure 26A:
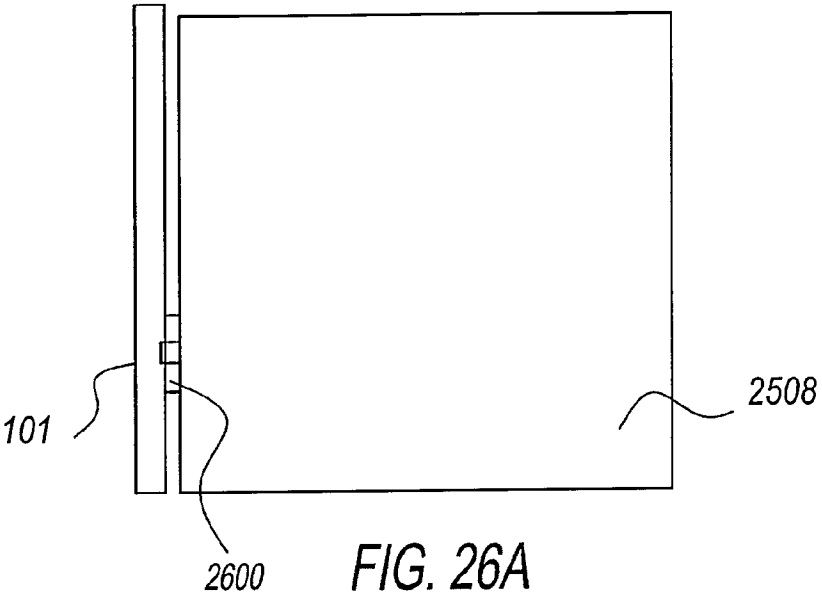
FIGS. 26A and 26B illustrate another exemplary feeding and grounding connection mechanism that uses PCB and a vertical grounding contact, according to certain embodiments.
Figure 26B:
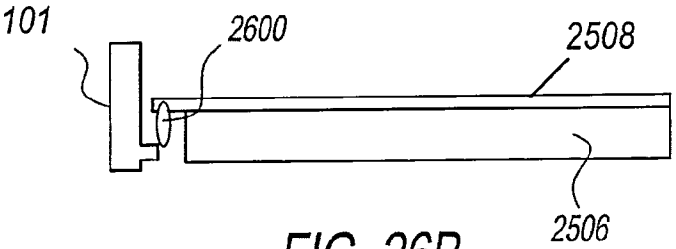

FIGS. 26A and 26B illustrate another exemplary feeding and grounding connection mechanism that uses PCB 2508 and a vertical grounding contact, according to certain embodiments. FIG. 26A illustrates a top view, and FIG. 26B illustrates a cross-sectional view of the feeding and grounding connection mechanism. In the example of FIGS. 26A and 26B, only one grounding location is shown. In some implementations, an antenna feed can be grounded at a point but can also be grounded at a larger area, such as at a ground plane of a component, such as the PCB 2508. FIGS. 26A and 26B illustrate the metallic frame 101 connected to the display and supporting structures 2506 via a vertical connector 2600, which can be a spring, pogo pin, or other type of vertical connector. Any matching networks, filter networks, inductors, capacitors, diplexers, switches, or the like that are used for antenna tuning as discussed previously can be installed on the flex-film layer 2500 and/or the display and supporting structures 2506.

Figure 27A:
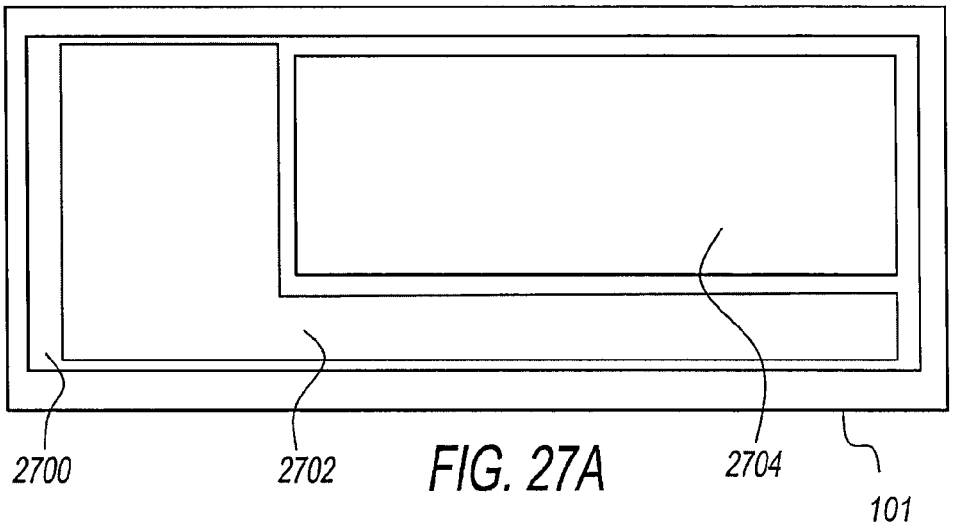
FIGS. 27A and 27B are exemplary illustrations of a block having various components disposed within a periphery of a multi-band frame antenna, according to certain embodiments.
Figure 27B:
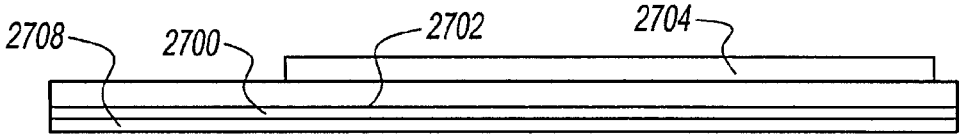

FIGS. 27A and 27B are exemplary illustrations of a block 103 having various components disposed within a periphery of a multi-band frame antenna, according to certain embodiments. FIG. 27A illustrates a top view, and FIG. 27B illustrates a cross-sectional view. In FIG. 27A, the metallic frame 101 can surround a plurality of stacked, laminated components that can be included in the structure of the block 103, according to some implementations. The laminated components can include a display 2708, a display plate 2700, PCB 2702 and battery 2704. In the example of FIGS. 27A and 27B, the area of a top surface of the battery 2704 is less than the area of a top surface of the PCB 2702 and is positioned approximately at a corner of the PCB 2702. The assembly of the laminated components is flexible as long as all these components are electrically connected and the PCB 2702 system ground is connected to the ground plane. The display signal bus and its ground may be electrically connected to the PCB 2702 via flexible plastic substrate, cable, or the like.

Figure 28A:
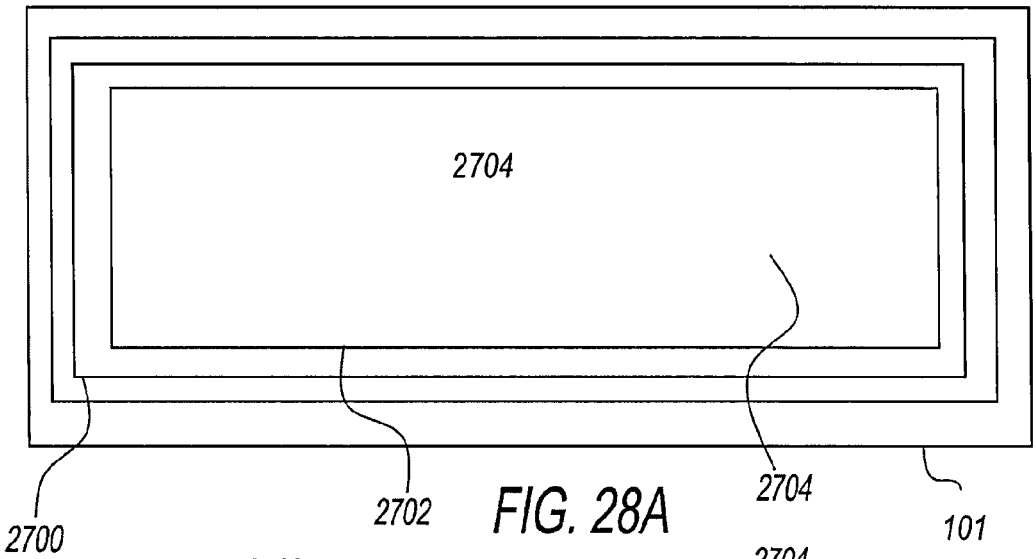
FIGS. 28A and 28B are exemplary illustrations of a block having various components disposed within a periphery of a multi-band frame antenna, according to certain embodiments.
Figure 28B:
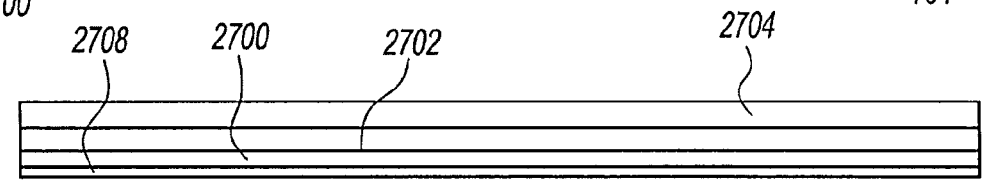

FIGS. 28A and 28B are additional exemplary illustrations of a block 103 having various components disposed within a periphery of a multi-band frame antenna, according to certain embodiments. FIG. 28A illustrates a top view, and FIG. 28B illustrates a cross-sectional view. The metallic frame 101 is can surround plurality of stacked, laminated components that can be included in the structure of the block 103, according to some implementations. The laminated components can include a display 2708, a display plate 2700, PCB 2702, and battery 2704. In the example of FIGS. 28A and 28B, the area of a top surface of the battery 2704 is less than the area of a top surface of the PCB 2702 and is positioned approximately at the center of the PCB 2702. The assembly of the laminated components is flexible as long as all these components are electrically connected and the PCB 2702 system ground is connected to the ground plane. The display signal bus and its ground may be electrically connected to the PCB 2702 via flexible plastic substrate, cable, or the like.

Figure 29:
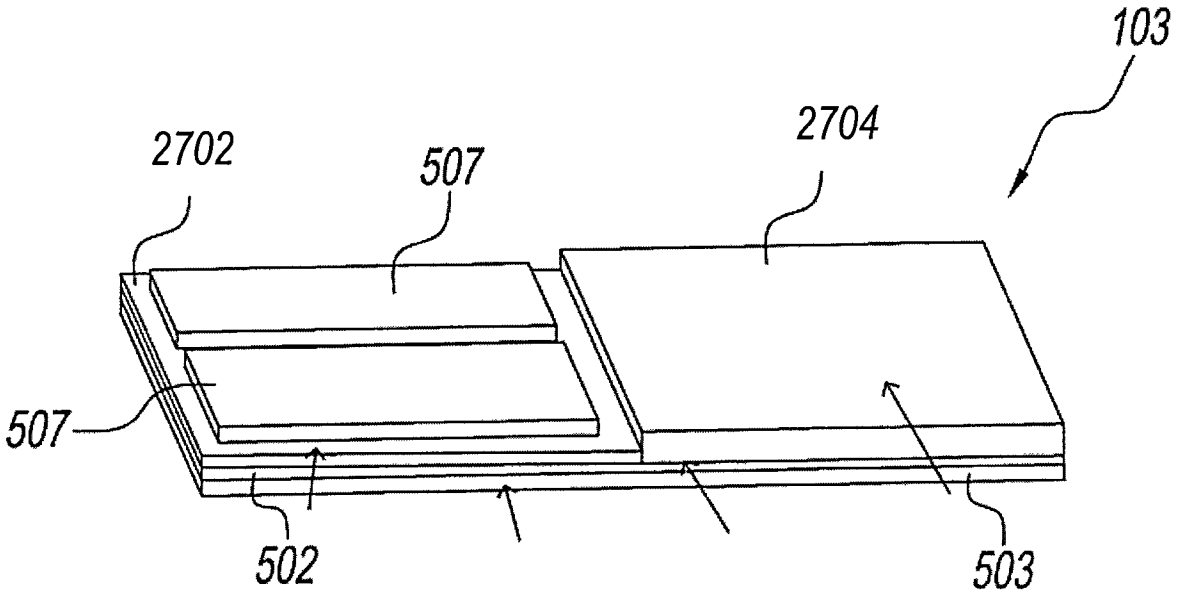
FIG. 29 is an exemplary illustration of a block having various components disposed within a periphery of a multi-band frame antenna, according to certain embodiments.

FIG. 29 is another exemplary illustration of a block 103 having various components disposed within a periphery of a multi-band frame antenna, according to certain embodiments. In FIG. 29, the basic electronic device assembly is shown without the metallic frame 101. The block 103 can include a display assembly 503, PCB 2702, shield cans 507 for shielding electronic components, and a battery 2704. The PCB 2702, the shield cans 507, and the battery 2704 can be stacked and their assembly is flexible as long as all these components are electrically connected and the PCB 2702 system ground is connected to the block 103. The display signal bus and its ground may be electrically connected to the PCB 2702 via flexible plastic substrate, cable, or the like.

Figure 30:
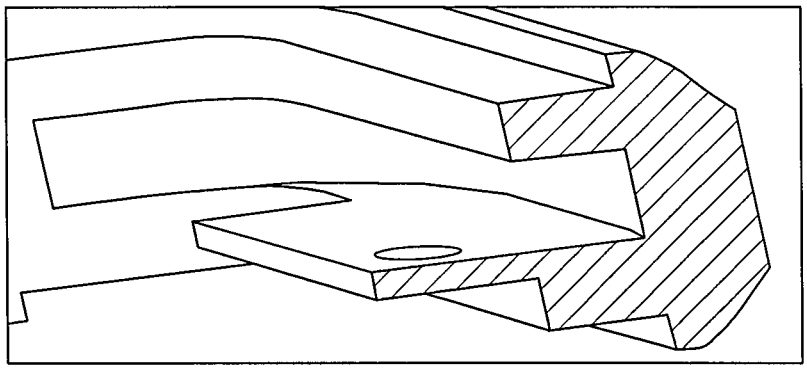
FIG. 30 is an exemplary illustration of a shape of the metallic frame, according to certain embodiments.

FIG. 30 is an exemplary illustration of a shape of the metallic frame 101, according to certain embodiments. The shape of the metallic frame 101 is not limited to a rectangular or round shape, but can also include shapes such as hexagonal, polygonal, recessed, extended, zig-zag, and the like so as to accommodate the periphery of the electronic device. In FIG. 30, the metallic frame 101 includes a recession on an inner surface and a non-rectangular shape.

Obviously, numerous modifications and variations of the present disclosure are possible in light of the above teachings. It is therefore to be understood that within the scope of the appended claims, the invention may be practiced otherwise than as specifically described herein.

The above disclosure also encompasses the embodiments listed below.

(1) A frame antenna including: a conductive block having at least one surface-mount electronic component mounted thereon; a metallic frame having a continuous annular structure with an inner void region, the metallic frame being disposed around a periphery of the conductive block and separated from the conductive block by a predetermined distance, the metallic frame overlapping an edge of an upper surface of the conductive block; and one or more antenna feeds disposed between the metallic frame and the conductive block, wherein the one or more antenna feeds have at least one electronic element connecting the conductive block to the metallic frame.

(2) The frame antenna of (1), wherein the conductive block is connected to the metallic frame by the at least one electronic element at one or more locations.

(3) The frame antenna of (1) or (2), further comprising at least one connection between the conductive block and the metallic frame that is a direct connection.

(4) The frame antenna of any one of (1) to (3), wherein the at least one electronic element connects the conductive block to the metallic frame via a switch.

(5) The frame antenna of any one of (1) to (4), wherein the at least one electronic element includes a filter network that tunes one or more frequencies of the one or more antenna feeds.

(6) The frame antenna of any one of (1) to (5), wherein the at least one electronic element includes a capacitor, an inductor, or a matching network.

(7) The frame antenna of any one of (1) to (6), wherein the at least one electronic element includes a diplexer that filters one or more frequencies from the one more antenna feeds.

(8) The frame antenna of any one of (1) to (7), wherein at least one parasitic radiator is connected to the one or more antenna feeds to tune one or more frequencies of the one or more antenna feeds.

(9) The frame antenna of any one of (1) to (8), wherein the at least one parasitic radiator is a branch-type parasitic radiator.

(10) The frame antenna of any one of (1) to (9), wherein the at least one parasitic radiator is a floating parasitic radiator.

(11) The frame antenna of any one of (1) to (10), wherein the at least one parasitic radiator extends from the one or more antenna feeds to the conductive block.

(12) The frame antenna of any one of (1) to (11), wherein the at least one parasitic radiator is loaded with an inductor, a capacitor, or a switch.

(13) The frame antenna of any one of (1) to (12), wherein a signal line of an audio jack can function as a coupling element for the one or more antenna feeds.

(14) The frame antenna of any one of (1) to (13), wherein one of the one or more antenna feeds includes a signal line of an audio jack.

(15) The frame antenna of any one of (1) to (14), wherein the at least one electronic element is mounted on at least one of a flexible plastic substrate or a printed circuit board of the conductive block.

(16) The frame antenna of any one of (1) to (15), wherein the conductive block is connected to the metallic frame via a horizontal connector and a supporting material.

(17) The frame antenna of any one of (1) to (16), wherein the conductive block is connected to the metallic frame via a vertical connector.

(18) The frame antenna of any one of (1) to (17), wherein the frame antenna is used in combination with a conventional antenna.

(19) The frame antenna of any one of (1) to (18), wherein the one or more antenna feeds include a cellular antenna feed and a non-cellular antenna feed.

(20) A frame antenna including: a conductive block having at least one surface-mount electronic component mounted thereon; a metallic frame having a continuous annular structure with an inner void region, the metallic frame being disposed around a periphery of the conductive block and separated from the conductive block by a predetermined distance, the metallic frame having a height from an upper surface to a lower surface that is equal to a distance from an upper surface to a lower surface of the conductive block; and one or more antenna feeds disposed between the metallic frame and the conductive block, wherein the one or more antenna feeds have at least one electronic element connecting the conductive block to the metallic frame.

The invention claimed is:

1. A frame antenna comprising:

a conductive block having at least one surface-mount electronic component mounted thereon;

a metallic frame having a continuous annular structure with an inner void region, the metallic frame being disposed around a periphery of the conductive block and separated from the conductive block by a predetermined distance, the metallic frame overlapping an edge of an upper surface of the conductive block;

a plurality of antenna feeds disposed between the metallic frame and the conductive block, wherein the plurality of antenna feeds have at least one electronic element connecting the conductive block to the metallic frame; and a plurality of grounding points disposed between the metallic frame and the conductive block, wherein each of the plurality of grounding points is associated with a signal path between another grounding point or one of the plurality of antenna feeds.

2. The frame antenna of claim 1, wherein the conductive block is connected to the metallic frame by the at least one electronic element at one or more locations.

3. The frame antenna of claim 1, further comprising at least one connection between the conductive block and the metallic frame that is a direct connection.

4. The frame antenna of claim 1, wherein the at least one electronic element connects the conductive block to the metallic frame via a switch.

5. The frame antenna of claim 1, wherein the at least one electronic element includes a filter network that tunes one or more frequencies of the plurality of antenna feeds.

6. The frame antenna of claim 1, wherein the at least one electronic element includes a capacitor, an inductor, or a matching network.

7. The frame antenna of claim 1, wherein the at least one electronic element includes a diplexer that filters one or more frequencies from the plurality of antenna feeds.

8. The frame antenna of claim 1, wherein at least one parasitic radiator is connected to the plurality of antenna feeds to tune one or more frequencies of the one or more antenna feeds.

9. The frame antenna of claim 8, wherein the at least one parasitic radiator is a branch-type parasitic radiator.

10. The frame antenna of claim 8, wherein the at least one parasitic radiator is a floating parasitic radiator.

11. The frame antenna of claim 8, wherein the at least one parasitic radiator extends from the plurality of antenna feeds to the conductive block.

12. The frame antenna of claim 8, wherein the at least one parasitic radiator is loaded with an inductor, a capacitor, or a switch.

13. The frame antenna of claim 1, wherein a signal line of an audio jack is a parasitic radiator for the plurality of antenna feeds.

14. The frame antenna of claim 1, wherein one of the plurality of antenna feeds includes a signal line of an audio jack.

15. The frame antenna of claim 1, wherein the at least one electronic element is mounted on at least one of a flexible plastic substrate or a printed circuit board of the conductive block.

16. The frame antenna of claim 1, wherein the conductive block is connected to the metallic frame via a horizontal connector and a supporting material.

17. The frame antenna of claim 1, wherein the one or more antenna feeds include a cellular antenna feed and a non-cellular antenna feed.

18. A frame antenna comprising:

a conductive block having at least one surface-mount electronic component mounted thereon;

a metallic frame having a continuous annular structure with an inner void region, the metallic frame being disposed around a periphery of the conductive block and separated from the conductive block by a predetermined distance, the metallic frame having a height from an upper surface to a lower surface that is equal to a distance from an upper surface to a lower surface of the conductive block;

a plurality of antenna feeds disposed between the metallic frame and the conductive block, wherein the plurality of antenna feeds have at least one electronic element connecting the conductive block to the metallic frame; and a plurality of grounding points disposed between the metallic frame and the conductive block, wherein each of the plurality of grounding points is associated with a signal path between another grounding point or one of the plurality of antenna feeds.

19. The frame antenna of claim 1, wherein the plurality of antenna feeds include a first antenna feed of the plurality of antenna feeds is associated with a first signal type, and a second antenna feed of the plurality of antenna feeds is associated with a second signal type.

20. The frame antenna of claim 19, wherein the first signal type corresponds to a first frequency band and the second signal type corresponds to a second frequency band.

* * * * *